US007962080B2

(12) United States Patent
Kameda

(10) Patent No.: US 7,962,080 B2
(45) Date of Patent: Jun. 14, 2011

(54) IMAGE HEATING APPARATUS

(75) Inventor: Seiichiro Kameda, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 172 days.

(21) Appl. No.: 12/470,218

(22) Filed: May 21, 2009

(65) Prior Publication Data

US 2009/0297233 A1 Dec. 3, 2009

(30) Foreign Application Priority Data

May 27, 2008 (JP) ..... 2008-137768

(51) Int. Cl.
*G03G 15/20* (2006.01)

(52) U.S. Cl. ..... 399/323; 399/45; 399/328

(58) Field of Classification Search ..... 399/45, 399/67, 69, 320, 322, 323, 328
See application file for complete search history.

(56) References Cited

U.S. PATENT DOCUMENTS

| | | | |
|---|---|---|---|
| 7,251,425 | B2 | 7/2007 | Kameda |
| 2008/0260425 | A1 | 10/2008 | Hirayama et al. |
| 2008/0260435 | A1 | 10/2008 | Chikugo et al. |

FOREIGN PATENT DOCUMENTS

| | | |
|---|---|---|
| JP | 9-80956 | 3/1997 |
| JP | 2008-040365 | 2/2008 |

*Primary Examiner* — David P Porta
*Assistant Examiner* — Mark R Gaworecki
(74) *Attorney, Agent, or Firm* — Fitzpatrick, Cella, Harper & Scinto

(57) ABSTRACT

An image heating apparatus includes a heating member for heating a toner image on a recording material in a heating nip, a pressing member for forming the heating nip and being in contact with the heating member, an abrading member for abrading a surface of the heating member, a contact-and-separation device for causing contact and separation of the abrading member with respect to the heating member; and a selecting device for selecting, depending on the basis weight of the recording material to be heated by the heating member, whether or not the contact-and-separation means brings the abrading member into contact with the heating member before a recording material is conveyed to the heating nip.

5 Claims, 14 Drawing Sheets

IMAGE HEATING APPARATUS

FIELD OF THE INVENTION AND RELATED ART

The present invention relates to an image heating apparatus (device) suitably used as an image heat-fixing device to be mounted in an image forming apparatus, such as a copying machine, a facsimile machine, or a printer, for forming a toner image on a recording material by an electrophotographic method, an electrostatic recording method, a magnetic recording method, or the like.

As a heating-type image fixing device in an image forming apparatus of an electrophotographic type, a fixing device for heat-fixing the toner image, in a fixing nip in which a fixing member and a pressing member contact each other, has been used conventionally.

However, a surface layer of the fixing member suffers the problem that the layer is gradually roughened due to attack by passing sheets or due to contamination with paper powder or offset toner, for example. Particularly, when a large number of sheets of the recording material is caused to pass through a certain position of the fixing member, the degree of roughening of a surface layer of a fixing roller (member) is different among a sheet passing area, a non-sheet-passing area, and a paper (sheet) edge portion at a boundary between the sheet passing area and the non-sheet-passing area. Further, when a separation claw (for separating the recording material, having passed through the fixing nip, from the fixing member) contacts the surface of the fixing member, a surface roughness in a contact area, in which the separation claw contacts the fixing roller and that in a non-contact area, in which the separation claw does not contact the fixing roller, are different from each other.

When the fixing member surface is roughened, a surface state of the fixing member is transferred onto the toner image surface. When the surface state of the fixing member is different, a difference in surface state correspondingly occurs on the toner image, with the result that uneven glossiness occurs.

Japanese Laid-Open Application (JP-A) 2008-40365 discloses a constitution for solving the above-described problem. In this constitution, the entire area of the fixing member (the sheet passing area, the non-sheet-passing area, and the sheet edge portion) is roughened so as to provide fine traces of abrasion by a roughening member having a surface layer uniformly provided with abrasive grains (#1000 to #4000). As the result, the difference between pits and projections at the surface of the fixing member is decreased by superposing the fine traces of abrasion deposited on the fixing member surface, so that low-gloss stripes, occurring at a sheet edge position on the toner image, and a difference in glossiness between in the sheet passing area and in the non-sheet-passing area are less conspicuous. Further, the fixing device in the image forming apparatus is constituted so that the roughening member is movable toward and away from the fixing member since the roughening member is contaminated with the offset toner or the like on the fixing member when the roughening member always contacts the fixing member. Further, a roughening operation is performed on a regular basis by providing a counter or in a user mode executable by a user, when the user is concerned about uneven image glossiness, by providing an operating portion with an operation button.

In recent years, the image forming apparatus has been required to provide a high image quality and high productivity. In order to improve productivity, it is necessary to increase the conveying speed of the recording material, so that it is desirable that the fixing device is capable of performing fixation even at a low conveying speed of the recording material.

However, when the fixing speed is increased and a recording material on which a solid image is formed is subjected to the fixation operation, it is found that the following problem occurs. That is, when thick paper is used as the recording material and the toner image is fixed on the thick paper, a sheet edge trace of abrasion, a separation claw trace, or the like left on the fixing roller surface is conspicuous on the toner image as the uneven glossiness.

A principal of the occurrence of the uneven glossiness on the toner image due to the sheet edge trace of abrasion, the separation claw trace, or the like left on the fixing roller surface in the cases of the high fixing speed and the use of the thick paper as the recording material will be described.

First, the relationship between the toner melting state and ease of the transfer of a surface shape of the fixing roller onto the toner image on the recording material (hereinafter referred to as a surface transfer property) will be described. The surface transfer property of the toner image (an output product) is largely affected by the smoothness of the recording material surface, the amount of the toner, and the toner melting state.

In the case where the toner amount is small, the surface transfer property is higher with lower smoothness of the recording material surface. This is because the glossiness of the toner is liable to be affected by the smoothness of the recording material surface.

As shown in FIG. 13(*a*), in the case where the toner amount is small, the toner image glossiness is liable to be affected by the smoothness of the recording material surface. However, as shown in FIG. 13(*b*), when the toner amount is increased, pits and projections of the recording material surface are filed with the toner. In this case, the toner image surface is less affected by the uneven recording material surface.

Therefore, as shown in FIG. 13(*c*), under the condition that the toner is sufficiently melted, the surface smoothness of the toner image after the fixation is increased with an increasing toner amount, thus resulting in a surface transfer property (surface transferability).

When the case of the low fixing speed and the case of the high fixing speed are compared by applying unfixed toner onto the surface of the thick paper as the recording material, the surface transfer property of the case of the high fixing speed is higher than that of the case of the low fixing speed. Further, when the case where the unfixed toner is applied onto the thick paper and the case where the unfixed toner is applied onto thin paper are compared at the same fixing speed, the surface transfer property of the case where the unfixed toner is applied onto the thick paper is higher than that in the case where the unfixed toner is applied onto the thin paper.

As a result of observation of an output product through a laser microscope ("VK8000 series", mfd. by KEYENCE CORP.) with respect to these phenomena, it has been found that the toner melting state is changed as described below. Therefore, the change in toner melting state will be described with reference to schematic views. FIGS. 14(*a*) to 14(*d*) are schematic views showing a toner melting process in the case of the low surface transfer property. Further, FIGS. 15(*a*) to 15(*d*) are schematic views showing the toner melting process in the case of the high surface transfer property.

FIG. 14(*a*) is the schematic view showing a state of the unfixed toner, FIG. 14(*b*) is en enlarged view of FIG. 14(*a*), FIG. 14(*c*) is a schematic view showing a state in which the toner is changed from the state of FIG. 14(*b*) to a melted state, and FIG. 14(*d*) is schematic view showing a state of the toner image surface on the recording material in the case where the unfixed toner is melt-fixed.

Further, FIG. 15(*a*) is the schematic view showing a state of the unfixed toner, FIG. 15(*b*) is en enlarged view of FIG. 15(*a*), FIG. 15(*c*) is a schematic view showing a state in which the toner is changed from the state of FIG. 15(*b*) to a melted state, and FIG. 15(*d*) is schematic view showing a state of the toner image surface on the recording material in the case where the unfixed toner is melt-fixed.

As shown in FIG. 14(*d*), in the case where a certain amount of toner is uniformly melted, an upper layer-side toner and a lower layer-side toner follow the surface of the recording material, so that the toner image surface is also liable to be affected by the uneven recording material surface. Therefore, the resultant surface toner property is low.

As shown in FIG. 15(*d*), in the case where the lower layer-side toner of the toner image is less liable to be melted, only the toner portion close to the surface of the toner image is melted, so that the toner image surface is less liable to be affected by the uneven recording material surface. As a result, the surface transfer property of the toner image is high.

As described above, in the case where the conveying speed of the recording material is high, the lower layer-side toner of the toner image is not sufficiently heated. As a result, the toner melting state is the state shown in FIG. 15(*d*), so that the surface transfer property of the toner image is high.

Further, in the case of the thin paper used as the recording material having a small thermal capacity, heat of the toner is less liable to be taken by the recording material and further the heat is liable to conduct from the back side of the paper, so that the lower layer-side toner is also heated sufficiently. As a result, the toner melting state is liable to be changed to the state of FIG. 14(*d*). On the other hand, in the case of the thick paper used as the recording material having a large thermal capacity, the heat of the toner is liable to be taken by the recording material and further the heat is less liable to conduct from the back side of the paper, so that the toner melting state is liable to be changed to the state of FIG. 15(*d*).

Thus, when the sheet edge trace of abrasion or the separation claw trace is present on the fixing roller surface, in the toner melting state as shown in the schematic view of FIG. 15(*d*), the influence of the uneven recording material surface is less liable to come to the surface of the toner image. Therefore, the surface smoothness of the toner image after image fixation is high. Further, with higher smoothness, the separation claw trace is more conspicuous. Therefore, when the thick paper is intended to be fixed in the high fixing speed state, the sheet edge trace of abrasion and the separation claw trace are conspicuous as uneven glossiness of the toner image.

When the roughening operation is always performed by the roughening member disclosed in JP-A 2008-40365, the surface of the roughening member clogs, so that the lifetime of the roughening member is shortened.

SUMMARY OF THE INVENTION

A principal object of the present invention is to solve the problem, that damage of a fixing member surface is transferred onto a toner image to cause uneven glossiness on the toner image after fixation, while avoiding a shortened lifetime of the roughening surface.

Another object of the present invention is to provide an image heating apparatus solving this problem.

According to an aspect of the present invention, there is provided an image heating apparatus comprising:

a heating member for heating a toner image on a recording material in a heating nip;

a pressing member for forming the heating nip in contact with the heating member;

an abrading member for abrading a surface of the heating member;

contact-and-separation means for permitting contact and separation of the abrading member with respect to the heating member; and selecting means for selecting, depending on the weight of the recording material to be heated by the heating member, whether or not the contact-and-separation means brings the abrading member into contact with the heating member before a recording material is conveyed to the heating nip.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the present invention will be described more specifically based on embodiments. Incidentally, these embodiments are preferred embodiments of the present invention but the present invention is not limited thereto.

Embodiment 1

(1) Image Forming Apparatus

Figure 1:
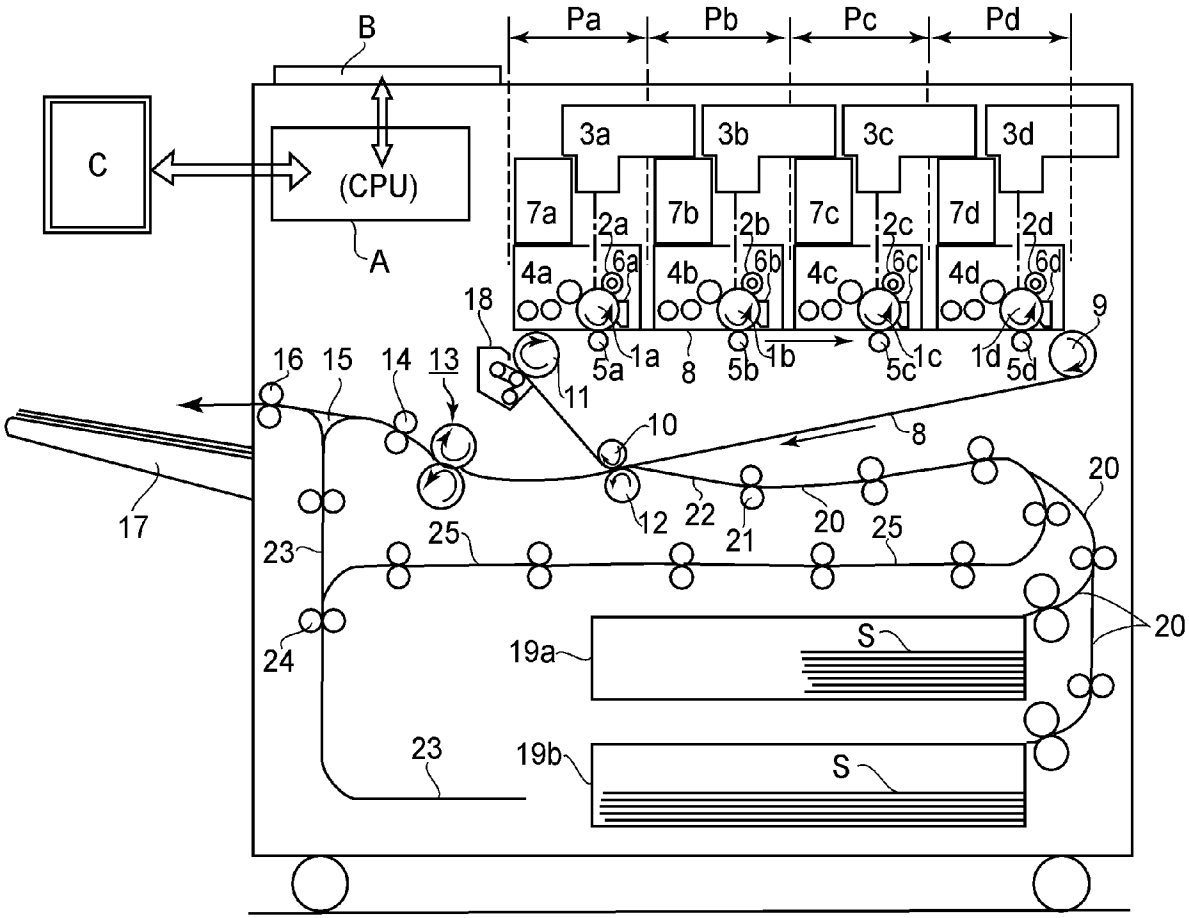
FIG. 1 is a schematic structural view of an embodiment of an image forming apparatus.

FIG. 1 is a schematic structural view of an embodiment of an image forming apparatus in which a heating apparatus (device) according to the present invention is mounted as a fixing device. This image forming apparatus is a full-color laser beam printer of an electrophotographic type wherein an image corresponding to electrical image information inputted from a host apparatus C, such as a personal computer or an image reader, to a controller (control means: CPU) A is formed on a recording material (transfer paper) S and is outputted. The controller A sends and receives various pieces of the electrical image information between the controller A and the host apparatus C or an operating display portion (operating portion) B and effects centralized control of an image forming operation of the image forming apparatus in accordance with a predetermined control program or a reference table.

In the apparatus, first to fourth image forming stations P (Pa, Pb, Pc and Pd) are provided in parallel and form toner images different in color through an electrophotographic process including latent image formation and development.

Each image forming station P is provided with a dedicated image bearing member, i.e., an electrophotographic photosensitive drum (1*a*, 1*b*, 1*c* or 1*d*) in this embodiment. Each photosensitive drum is rotationally driven in a counterclockwise direction indicated by an arrow at a predetermined speed, so that an associated color toner image is formed thereon. Adjacent to the respective photosensitive drums 1*a*, 1*b*, 1*c* or 1*d*, an intermediary transfer belt 8 as an intermediary transfer apparatus is provided. The respective color toner images formed on the respective photosensitive drums 1*a*, 1*b*, 1*c* or 1*d* are primary-transferred onto the intermediary transfer belt 8 in a superposition manner and then are transferred onto the recording material at a secondary transfer portion. The recording material onto which the toner images are transferred is introduced into a fixing device 13 and is subjected to a toner image fixing process under the application of heat and pressure. Thereafter, the recording material is discharged on a sheet discharge tray 17 located outside the apparatus as an image-formed product (a full-color print).

At an outer peripheral portion of each of the photosensitive drums 1*a*, 1*b*, 1*c* or 1*d*, a drum charger (2*a*, 2*b*, 2*c* or 2*d*), a developing device (4*a*, 4*b*, 4*c* or 4*d*), a primary transfer charger (5*a*, 5*b*, 5*c* or 5*d*), and a drum cleaner (6*a*, 6*b*, 6*c* or 6*d*) are provided. Each drum charger 2*a*, 2*b*, 2*c*, 2*d* electrically charges the peripheral surface of its respective photosensitive drum 1*a*, 1*b*, 1*c*, or 1*d* uniformly to a predetermined polarity and a predetermined potential. Above each of the photosensitive drums 1*a*, 1*b*, 1*c* or 1*d* a corresponding laser scanner (3*a*, 3*b*, 3*c* and 3*d*) is provided. Each of the laser scanners 3*a*, 3*b*, 3*c*, 3*d* includes a light source device, a polygon mirror, an fθ lens, and the like although these devices are omitted from illustration. Laser light emitted from the light source device of each laser scanner is used for scanning by rotating the polygon mirror and beams of the scanning light are deflected by a reflection mirror and are focused on a generating line on the corresponding photosensitive drum 1*a*, 1*b*, 1*c* or 1*d* to effect light exposure of the corresponding photosensitive drum surface. By this scanning exposure to the laser beam, the surface of each photosensitive drum 1*a*, 1*b*, 1*c* or 1*d* electrically charged by the drum charger 2*a*, 2*b*, 2*c*, 2*d*, has formed thereon an electrostatic latent image corresponding to an image signal.

In the developing devices 4*a*, 4*b*, 4*c* and 4*d*, as developers, color toners of yellow, magenta, cyan, and black are contained, respectively, in a predetermined amount. Into each of the developing devices 4*a*, 4*b*, 4*c*, 4*d*, associated toner is appropriately supplied from associated supplying devices (7*a*, 7*b*, 7*c* and 7*d*). The respective developing devices 4*a*, 4*b*, 4*c*, 4*d* develop latent images on the associated photosensitive drums 1*a*, 1*b*, 1*c*, 1*d* into visualized images of yellow toner image, a magenta toner image, a cyan toner image, and a block toner image, respectively.

The intermediary transfer belt 8 is stretched around a driving roller 9, a secondary transfer opposite roller 10, and a tension roller 11 and is rotationally driven in a clockwise direction indicated by an arrow at the same peripheral speed as that of the respective photosensitive drums 1*a*, 1*b*, 1*c* or 1*d*.

The yellow toner image of a first color formed and carried on the photosensitive drum 1*a* of the first image forming station Pa is intermediary-transferred onto the intermediary transfer belt 8 during passing thereof through a nip (primary transfer portion) between the photosensitive drum 1*a* and the intermediary transfer belt 8. That is, by nip pressure and an electric field formed by a primary transfer bias applied to the primary transfer charger 5*a*, the yellow toner image is intermediary-transferred onto the outer peripheral surface of the intermediary transfer belt 8.

Thereafter, in a similar manner, the magenta toner image of a second color for the second image forming station Pb, the cyan toner image of a third color for the third image forming station Pc, and the black toner image of a fourth color for the fourth image forming station Pd are transferred onto the intermediary transfer belt 8 in the superposition manner. As a result, on the intermediary transfer belt 8, unfixed synthetic color toner images corresponding to the color image information inputted from the host device C to the controller A are formed.

The surface of each photosensitive drum 1*a*, 1*b*, 1*c*, 1*d* after being subjected to the primary transfer of the toner image onto the intermediary transfer belt 8 is subjected to removal of primary transfer residual toner (cleaning) by its respective drum cleaner 6*a*, 6*b*, 6*c*, 6*d* and prepares for a next latent image formation and subsequent steps.

Against the secondary transfer opposite roller 10, the intermediary transfer belt 8 is pressed by a secondary transfer roller 12. The secondary transfer roller 12 is supplied with bearings and extends parallel with the secondary transfer opposite roller 10 so as to contact the intermediary transfer belt 8. A nip between the intermediary transfer belt 8 and the secondary transfer roller 12 is a secondary transfer portion. To the secondary transfer roller 12, a predetermined secondary transfer bias is applied with a predetermined control timing.

The transfer of the synthetic color toner images, transferred onto the intermediary transfer belt 8 in a superposition manner, onto the recording material S is performed by introducing the recording material S into the secondary transfer portion. That is, one of sheets of the recording material S is separated and fed from a first or second sheet feeding cassette 19*a* or 19*b* with a predetermined control timing by an operation of a sheet feeding mechanism. The recording material S is conveyed through a sheet path 20 and passes through a registration roller 21 and a pre-transfer guide 22 to be conveyed to the secondary transfer portion with a predetermined control timing and at the same time, a secondary transfer bias is applied to the secondary transfer roller 12. By this secondary transfer bias, the synthetic color toner images are collectively transferred from the intermediary transfer belt 8 onto the recording material S.

Secondary transfer residual toner and other foreign matter which remain on the intermediary transfer belt 8 are wiped with a cleaning web (nonwoven fabric) of a belt cleaner 18.

The recording material S subjected to the secondary transfer of the unfixed synthetic color toner images at the secondary transfer portion is separated from the intermediary transfer belt 8 and introduced into the fixing device 13 to be subjected to the toner image fixing process under the application of heat and pressure. Then, the recording material S comes out of the fixing device 13 and is conveyed by a conveying roller pair 14 and thereafter passes through an upper side of a flapper 15 and is discharged on the sheet discharge tray 17 located outside the apparatus (the case of a one-side image forming mode).

In the case of a two-side image forming mode, the recording material S, coming out of the fixing device, which has already been subjected to the one-side image formation (image formation on a front surface) is conveyed by the conveying roller pair 14 and is guided into a reverse path 23 by the flapper which has been changed in attitude. Then, the recording material S is reversed by a reversing roller (a switchback roller) 24 to be guided into a two-side path 25 and is introduced into the secondary transfer portion again through the sheet path 20, the registration roller 21, and the pre-transfer guide 22. As a result, the recording material S is subjected to the secondary transfer of the toner images on a second (back) surface of the recording material S. Then, the recording material S is separated from the intermediary transfer belt 8 and is introduced into the fixing device 13 again to be subjected to the toner image fixing process with respect to the second surface. The flapper 15 is changed in attitude to its original attitude during the two-side image formation on the recording material S. As a result, the two-side image-formed recording material S coming out of the fixing device 13 is conveyed by the conveying roller pair 14 and passes through the upper side of the flapper 15, thus being discharged on the sheet discharge tray 17 located outside the apparatus by the sheet discharge roller 16.

(2) Fixing Device 13

Figure 2:
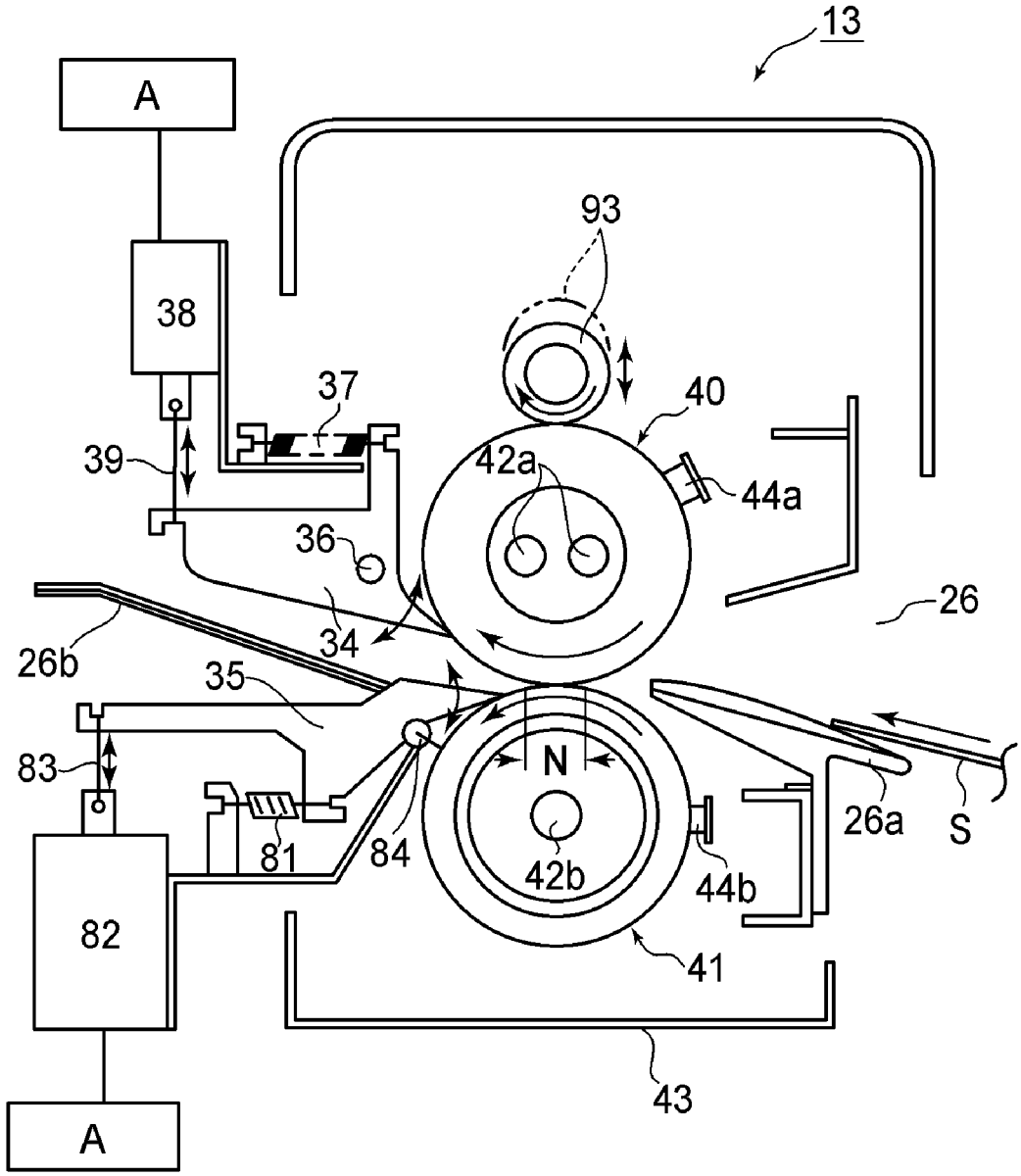
FIG. 2 is an enlarged cross-sectional view of a fixing device of Embodiment 1.
Figure 3:
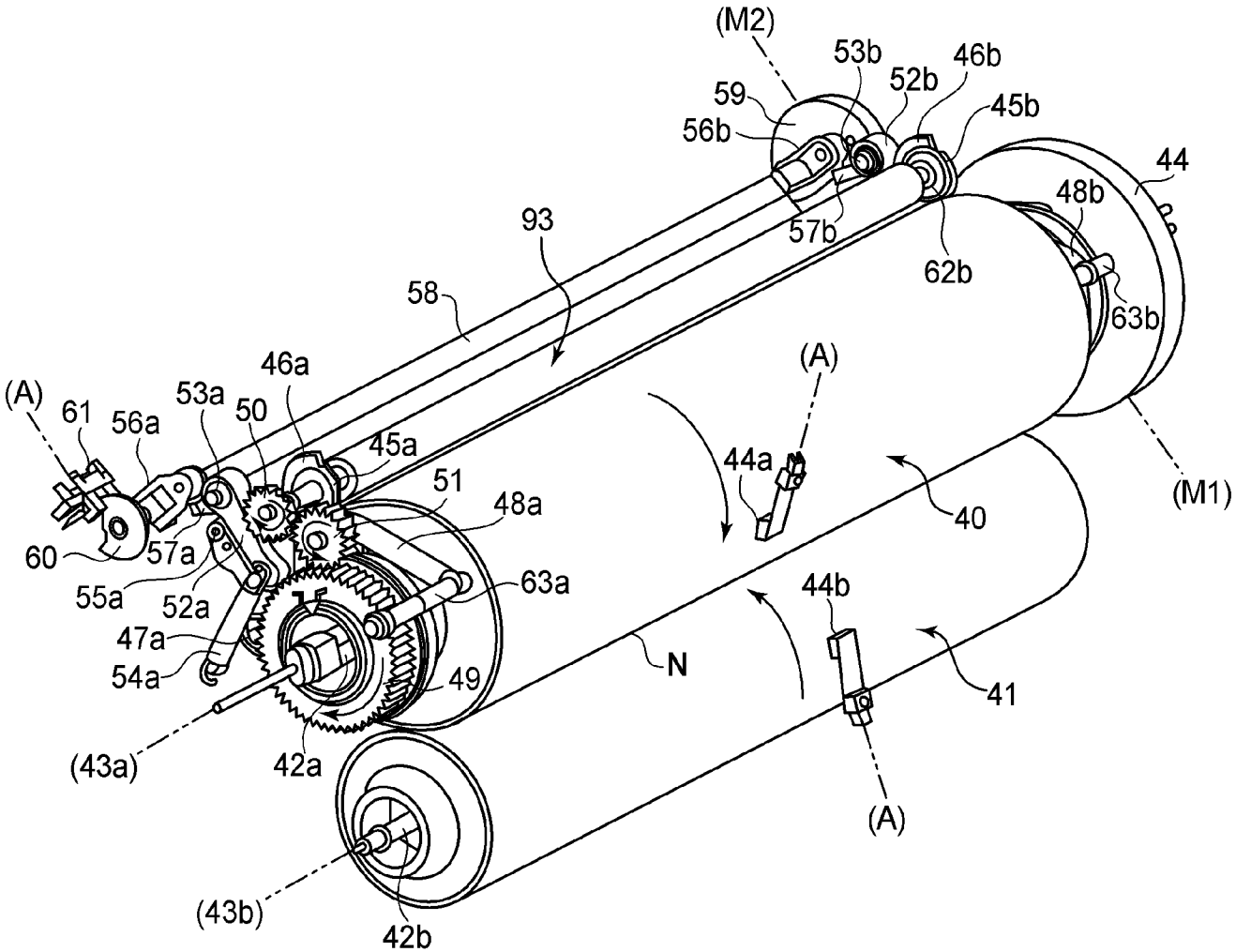
FIG. 3 is a perspective view of a principal portion of the fixing device.
Figure 4:
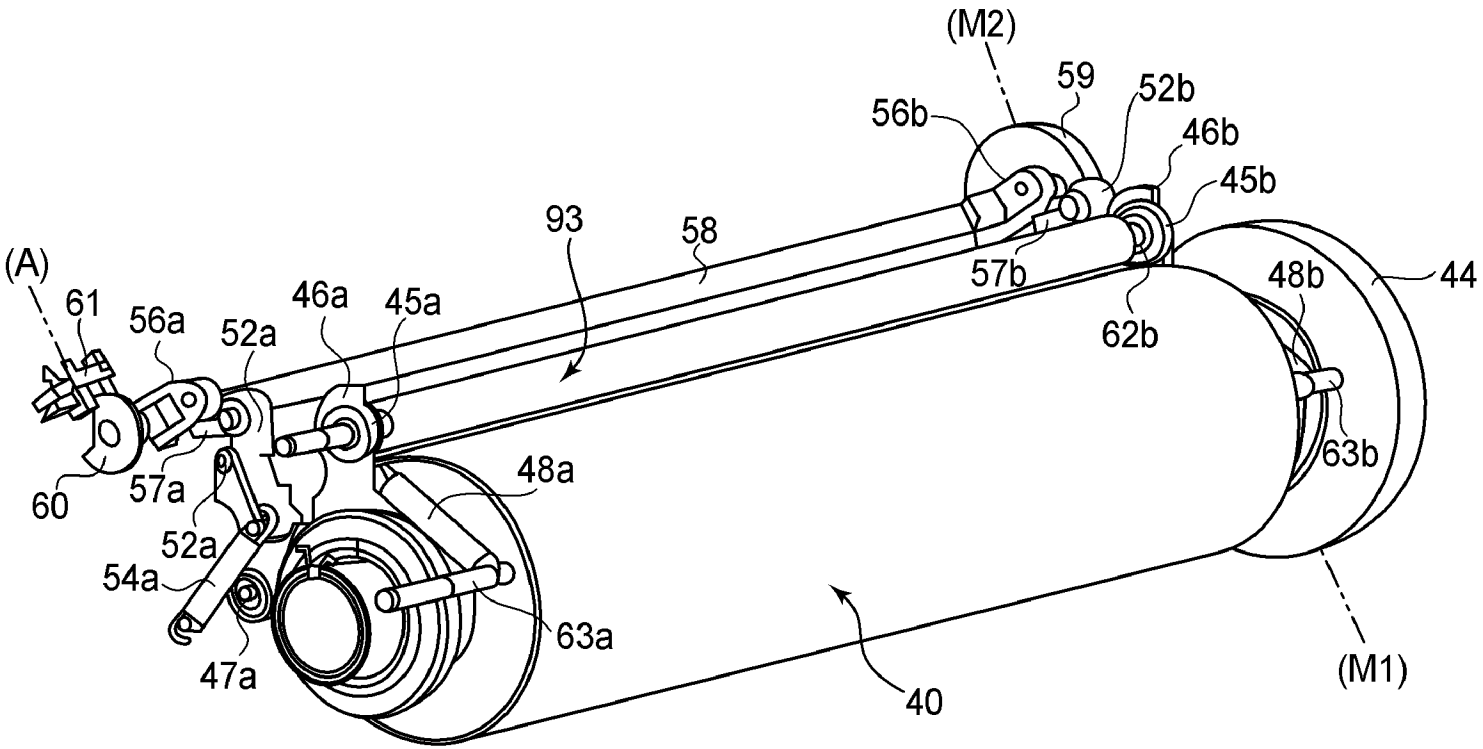
FIG. 4 is a perspective view showing a mounting and demounting mechanism of a roughening roller with respect to a fixing roller.
Figure 5:
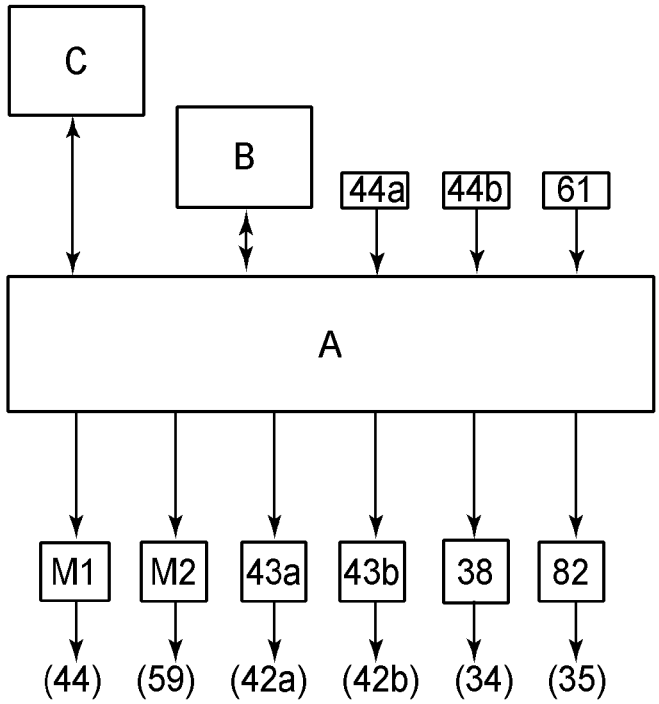
FIG. 5 is a block diagram of a control system.

FIG. 2 is an enlarged cross-sectional view of the fixing device 13, and FIG. 3 is a perspective view of a principal portion of the fixing device 13. FIG. 4 is a schematic view of a mounting and demounting mechanism of a roughening roller with respect to a fixing roller, and FIG. 5 is a block diagram of a control system.

The fixing device 13 is an image heating apparatus of a heating roller type and includes a fixing roller 40 and a pressing roller 41 as a pair of rotatable members which contact each other to form a heating nip (fixing nip) for heating the toner images on the recording material.

Herein, a front side of the fixing device 13 refers to an entrance side 26 of the recording material S. Left and right sides of the fixing device 13 refer to those as seen from the front side of the fixing device 13.

In this embodiment, the fixing roller 40 is prepared by forming a 2.0 mm-thick silicone rubber layer, as an elastic layer, having a rubber hardness of 20 degrees (JIS-A 1 kg weight) on a core metal consisting of a hollow pipe of Al having an outer diameter of 66 mm. Further, the surface of the elastic layer is coated with a 50 μm-thick fluorine-containing resin material layer as a surface parting layer to prepare an elastic roller having an outer diameter of 70 mm. The surface parting layer is a fluorine-containing resin material tube. Generally, the fluorine-containing resin material tube is constituted by PFA resin (tetrafluoroethylene-perfluoroalkoxyethylene copolymer) PTFE (polytetrafluoroethylene), or the like.

Further, the pressing roller 41 is prepared, similarly as in the case of the fixing roller 40, by forming a 2.0 mm-thick silicone rubber layer, as an elastic layer, having a rubber hardness of 20 degrees (JIS-A 1 kg weight) on a core metal consisting of a hollow pipe of Al having an outer diameter of 66 mm. Further, the surface of the elastic layer is coated with a 50 μm-thick fluorine-containing resin material layer as a surface parting layer to prepare an elastic roller having an outer diameter of 70 mm.

By combining the above-constituted fixing roller 40 and pressing roller 41, the parting property thereof with respect to the toner is further enhanced.

The fixing roller 40 and the pressing roller 41 are vertically disposed in parallel and rotatably held by bearings between left and right side plates (not shown) of a device frame 43. The fixing roller 40 and the pressing roller 41 press-contact each other against the elastic layers thereof with a total pressure of about 1666N (170 kgf) by a pressing mechanism (not shown). As a result, a nip (fixing nip) N having a predetermined width is formed between the fixing roller 40 and the pressing roller 41 with respect to a recording material conveyance direction.

On a right end side (driving side) of the core metal of the fixing roller 40, a drive inputting gear 44 is provided concentrically integral with the fixing roller 40. To this drive inputting gear 44, a driving force is transmitted from a driving means M1 to rotationally drive the fixing roller 40 in a clockwise direction indicated by an arrow in FIG. 2 at a predetermined speed. The pressing roller 41 is rotated in a counterclockwise direction indicated by an arrow by the rotational drive of the fixing roller 40. In this embodiment, the driving speed of the fixing roller 40 is set so that the conveyance speed of the recording material 3 is 700 mm/sec.

Into the inside of the core metal of the fixing roller 40*m* a halogen heater 42*a* as a heating means is inserted and disposed. Further, also into the inside of the core metal of the pressing roller 41, a halogen heater 42*b* as the heating means is inserted and disposed. To the halogen heaters 42*a* and 42*b*, electric power is supplied from electric energy supplying portions 43*a* and 43*b*, respectively. As a result, the halogen heaters 42*a* and 42*b* generate heat, so that the fixing roller 40 and the pressing roller 41 are heated from the insides thereof. Further, thermistors 44*a* and 44*b* as temperature detection means for detecting temperatures of the fixing roller 40 and the pressing roller 41, respectively, are provided in contact with outer surfaces of the fixing roller 40 and the pressing roller 41.

With respect to the fixing roller 40, a roughening roller (roughening member) 93 as an abrading member for abrading the surface of the fixing roller 40 is provided for movement toward and away from the fixing roller 40.

On a recording material exit side of the fixing nip N, an upper separation claw 34 contactable to the fixing roller 40 and a lower separation claw 35 contactable to the pressing roller 41 are swingably provided. The upper separation claw 34 and the lower separation claw 35 are separation members for separating the recording material from the fixing roller 40 and the pressing roller 41.

The controller A turns on the driving means M1 and the electric energy supplying portions 43*a* and 43*b* with a predetermined control timing. Into the controller A, temperature detection information of the thermistors 44*a* and 44*b* (electric information on temperatures of the fixing roller 40 and the pressing roller 41) is inputted. The controller A controls electric power supplied from the electric energy supplying portion 43*a* to the halogen heater 42*a* and electric power supplied from the electric energy supplying portion 43*b* to the halogen heater 42*b* so that the temperature detection information inputted from the thermistors 44*a* and 44*b* is used to control the electric power supplied to the heaters 42*a* and 42*b* to set the temperature of the fixing roller 40 and the pressing roller 41 to a predetermined set temperature (fixing temperature). In this embodiment, the controller A transfer-controls the fixing roller 40 and the pressing roller 41 so that the transfers of the fixing roller 40 and the pressing roller 41 are increased up to about 180° C. as the fixing temperature and are kept at a substantially constant level. In this state, the recording material S carrying the unfixed toner images is introduced from the entrance 26 into the fixing device 13 and is guided by an entrance-side guide 26*a* to enter the fixing nip N, thus being heated and pressed by being nip-conveyed in the fixing nip N (by a heating operation of the fixing roller 40 and the pressing roller 41). As a result, the unfixed toner images are fixed on the recording material S as a fixed image. The recording material S having passed through the fixing nip N is separated from the fixing roller 40 and the pressing roller 41 by the upper separation claw 34 and the lower separation claw 35 and is guided by an exit-side guide 26*b*, thus coming out of the fixing device 13 to be further conveyed by the conveying roller pair 14.

(3) Roughening Roller 93 and Mounting and Demounting Mechanism

Figure 6:
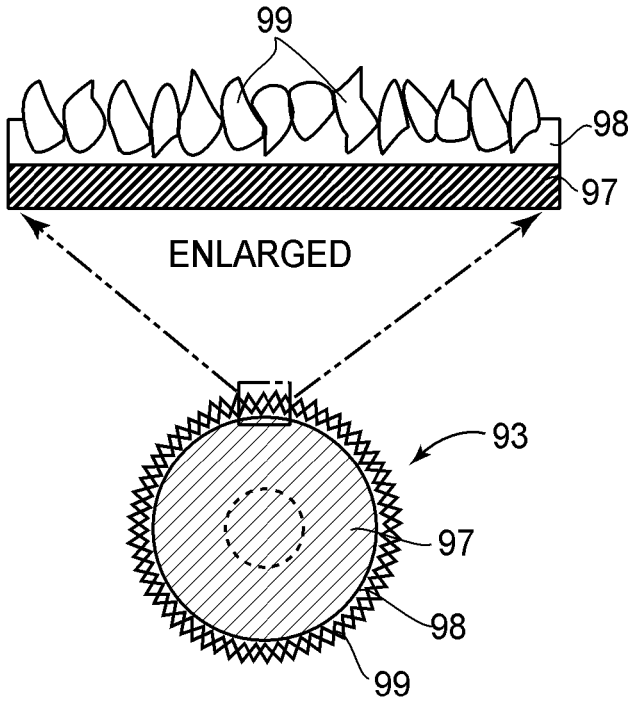
FIG. 6 is a schematic view for illustrating the roughening roller.

FIG. 6 is a schematic view for illustrating a structure of the roughening roller 93. In this embodiment, the roughening roller 93 is prepared by hermetically bonding abrasive grains to an outer peripheral surface of a core metal 97, of SUS having a diameter of 12 mm, through an adhesive layer 98. The abrasive grains 99 have a grain size of #1000 to #4000 and have a grain size distribution. The grain size of #1000 corresponds to about 16 μm and the grain size of #4000 corresponds to about 3 μm. The abrasive grains 99 are those of alumina (also commonly called "Alundum" or "molundum"). The alumina abrasive grains are widely used and have a sufficiently higher hardness than that of the fixing roller 40 and have an acute shape, thus being excellent in machinability.

As the roughening roller 93, those having a surface roughness Rz of 3 μm to 16 μm can be used. Below 3 μm, the fine traces of abrasion are not left on the fixing roller 40, so that a roughening effect is not achieved. Above 16 μm, large traces of abrasion are excessively left on the fixing roller 40, so that the traces of abrasion appear as an image on the recording material.

The surface roughness Rz can be measured by using a surface roughness measuring device ("SE-3400", mfd. by Kosaka Laboratory Ltd.) under a measuring condition including a feeding speed of 0.5 mm/sec, a cut off of 0.8 mm, and a measuring length of 2.5 mm.

The roughening roller 93 is disposed substantially in parallel with the fixing roller 40 so as to be movable toward and away from the fixing roller 40. Mounting of the roughening roller 93 to the fixing device 13 will be described with reference to FIGS. 3 and 4. In the following description, members corresponding to parenthesized reference symbols are not visible in the figures due to overlapping with other members.

The roughening roller 93 is supported by being rotatably mounted to a pair of left and right supporting members 46*a* and 46*b* through bearings 45*a* and 45*b* at both end portions thereof. The supporting members 46*a* and 46*b* are rotatably supported about supporting shafts 47*a* and (47*b*), respectively. Further, on the supporting members 46*a* and 46*b*, urging springs 48*a* and 48*b* for rotationally urging the supporting members 46*a* and 46*b* about the supporting shafts 47*a* and (47*b*) so that the roughening roller 93 can be moved to contact the fixing roller 40 are hooked. The urging springs 48*a* and 48*b* are locked by fixed spring hooking shafts at other ends. In this embodiment, by these urging springs, an urging force of 10 N to 150 N as a total pressure for urging the roughening roller 93 against the fixing roller 40 is generated. The roughening roller 93 is fixed with a gap by longitudinal left and right E-shaped stopper (snap) rings (62*a*) and 62*b* so that the roughening roller 93 does not stretch to the bearings 45*a* and 45*b* even when the roughening roller 93 is thermally expanded.

Next, a contact-and-separation mechanism for movement of the roughening roller 93 toward and away from the fixing roller 40 will be described. A pair of left and right retraction arms 52*a* and 52*b* are rotatably mounted about rotational shafts 53*a* and 53*b* corresponding to the above-described supporting members 46*a* and 46*b*. The retraction arms 52*a* and 52*b* are rotationally urged about the rotational shafts 53*a* and 53*b* by retraction springs 54*a* and (54*b*) so as to contact the supporting members 46*a* and 46*b* at portions 55*a* and (55*b*). The supporting members 46*a* and 46*b* are configured to be rotationally driven about the supporting shafts 47*a* and (47*b*) against the forces of the retraction springs 54*a* and 54*b* by the contact of the retraction arms 52*a* and 52*b* therewith at the portions 55*a* and (55*b*). When the supporting members 46*a* and 46*b* are rotationally driven by the forces of the retraction springs 54*a* and 54*b*, the roughening roller 93 is moved apart from the fixing roller 40.

At portions 57*a* and 57*b*, operation arms 56*a* and 56*b* contact the retraction arms 52*a* and 52*b*. The operation arms 56*a* and 56*b* are rotatably more about an arm shaft 58. The arm shaft 58 is rotationally driven by a driving means M2 through a drive input gear 59 provided at an end (right end) thereof. To the other end (left end) of the arm shaft 58, a rotational movement detection flag 60 is attached and a photo-sensor 61 for detecting a rotational phase of the rotational movement detection flag 60 is provided to the flag 60. The controller A controls the driving means M2 by the flag 60 and the photosensor 61, thereby controlling rotational phase angles of the operation arms 56*a* and 56*b*.

When the operation arms 56*a* and 56*b* press the retraction arms 52*a* and 52*b* at the portions 57*a* and 57*b*, the retraction arms 52*a* and 52*b* rotate about the rotational shafts 53*a* and 53*b* against the forces of the retraction springs 54*a* and (54*b*). In interrelation with the rotational movement of the retraction arms 52*a* and 52*b*, the supporting members 46*a* and 46*b* rotationally move about the supporting shafts 47*a* and (47*b*) by the forces of the urging springs 48*a* and 48*b*. As a result, the roughening roller 93 is pressed against the fixing roller 40 (a contact operation of the roughening roller 93 with respect to the fixing roller 40).

That is, the rotational phase angles of the operation arms 56*a* and 56*b* are controlled by the driving means M2 controlled by the controller A, so that the roughening roller 93 is detachably controlled between a press-contact state and a separated state with respect to the fixing roller 40.

The controller A normally controls the driving means M2 so that the operation arms 56*a* and 56*b* are held at the rotational phase angles at which they do not press the portions 57*a* and 57*b* of the retraction arms 52*a* and 52*b*. As a result, the roughening roller 93 is held in the separated state from the fixing roller 40 by the above-described mechanism. When the operation arms 56*a* and 56*b* are held at the rotational phase angles at which they press the portions 57*a* and 57*b* of the retraction arms 52*a* and 52*b* by controlling the driving means M2 by the controller A, the roughening roller 93 is placed in the press-contact state with respect to the fixing roller 40. In this embodiment, the contact-and-separation mechanism as a contact-and-separation means for measurement of the roughening roller 93 toward and away from the fixing roller 40 is constituted by the driving means M2, the operation arms 56*a* and 56*b*, the retraction arms 52*a* and 52*b*, the supporting members 46*a* and 46*b*, and the urging springs 48*a* and 48*b*.

Next, with reference to FIG. 3, the driving of the roughening roller 93 will be described. To a roller shaft of the fixing roller 40 on a non-driving side (left end side), a roughening roller drive transmission gear 49 is fixedly provided coaxially with the fixing roller 40. Therefore, the gear 49 is rotated integrally with the fixing roller 40. On a left end side of the roughening roller 93, a roughening roller drive input gear 50 is provided. A roughening roller driving force is transmitted from the gear 49 to the gear 50 through an idler gear 51. By the mediation of the idler gear 51, the roughening roller 93 rotates in a counter direction with respect to the rotation of the fixing roller 40 (in a direction opposite from the rotational direction of the fixing roller 40 at their contact portion). In this embodiment, the peripheral speed of the fixing roller 40 is set at 700 mm/sec and that of the roughening roller 93 is set at 350 mm/sec. By the rotational driving of the roughening roller 93 in the counter direction with respect to the fixing roller 40, the relative speed difference between the fixing roller 40 and the roughening roller 93 is set at 1050 mm/sec.

The roughening roller drive input gear 50 is mounted to and demounted from (engaged with and disengaged from) the idler gear 51 by the mounting and demounting of the roughening roller 93 with respect to the fixing roller 40. When the roughening roller 93 contacts the fixing roller 40, the roughening roller drive input gear 50 engages with the idler gear 51. As a result, the rotation of the gear 49 is transmitted to the gear 50 through the idler gear 51 to rotationally drive the roughening roller 93. When the roughening roller 93 is separated from the fixing roller 40, the gear 50 is separated from the idler gear 51 and is not engaged with the idler gear 51, so that the driving force is not transmitted to the roughening roller 93.

(4) Separation Claws 34 and 35 and Mounting and Demounting Mechanism

The structure of the separation claws 34 and 35 will be described with reference to FIG. 2. The upper separation claw 34 is provided so as to contact the fixing roller 40 and the lower separation claw 35 is provided so as to contact the pressing roller 41. The recording material S having passed through the nip N is separated from the fixing roller 40 and the pressing roller 41 by the upper separation claw 34 and the lower separation claw 35 and comes out of the fixing device 13 to be further conveyed by the conveying roller pair 14 shown in FIG. 1.

Figure 7:
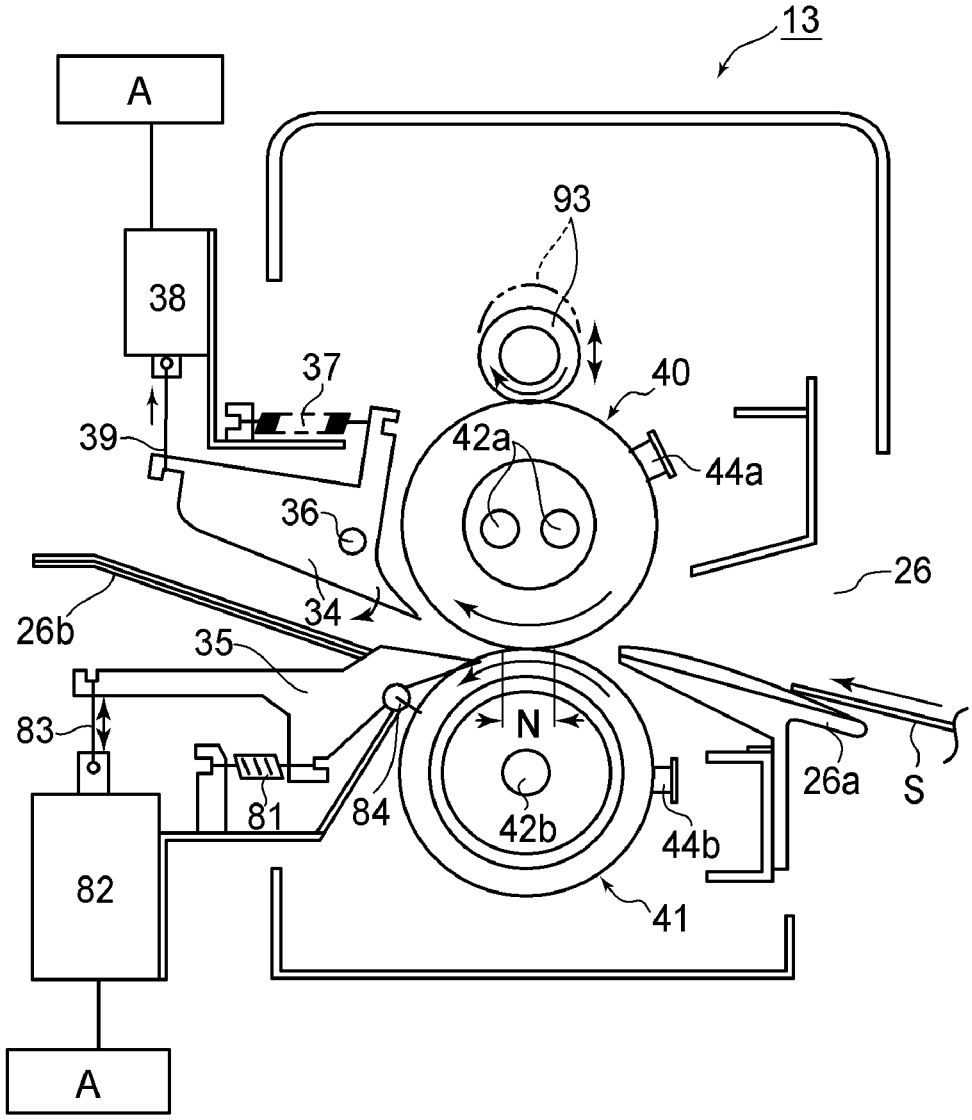
FIG. 7 is an enlarged cross-sectional view of the fixing device in a state in which an upper separation claw is separated from the fixing roller.

The upper separation claw 34 will be described more specifically. The upper separation claw 34 is provided in a plurality of separation claw portions along a longitudinal direction of the fixing roller 40. The upper separation claw 34 is rotatably supported about the supporting shaft 36 and contacts the fixing roller 40 with a predetermined pressure (=0.049 N (5 gf) by a spring 37. On a rear end side of the upper separation claw 34, a wire 39 connected to a solenoid 38 as a driving means, which is to be turned on and off by the controller A, is mounted. When the solenoid 38 is turned on, the upper separation claw 34 is pulled up against the spring 37 on the rear side thereof. As a result, the upper separation claw 34 is rotationally moved about the supporting shaft 36 in a direction in which the upper separation claw 34 is moved apart from the fixing roller 40, so that a front end portion of the upper separation claw 34 is slightly separated from the surface of the fixing roller 40. That is, the upper separation claw 34 is separated from a separation position, in which a separation operation is performed, by turning on the solenoid 38. The distance between the fixing roller 40 and the front end of the upper separation claw 34 is set at 1 mm to 1.5 mm during heating of the fixing roller 40. This state is shown in FIG. 7. As the solenoid 38, a latching solenoid is used. The latching solenoid is configured so that a current passes through the solenoid when the solenoid is turned on and off, so that a resultant state thereof after the current passes through the solenoid can be held by a magnetic force without the passing of the current.

The solenoid 38 may be provided to each of the separation claws but may also perform a mounting and demounting operation of all the separation claws by a single solenoid 38. As the mounting and demounting mechanism for the upper separation claw 34, a constitution in which the upper separation claw 34 is rotationally moved about the supporting shaft 36 is described above but it is also possible to employ such a constitution that the upper separation claw 34 is slid together with a separation claw supporting table.

Figure 8:
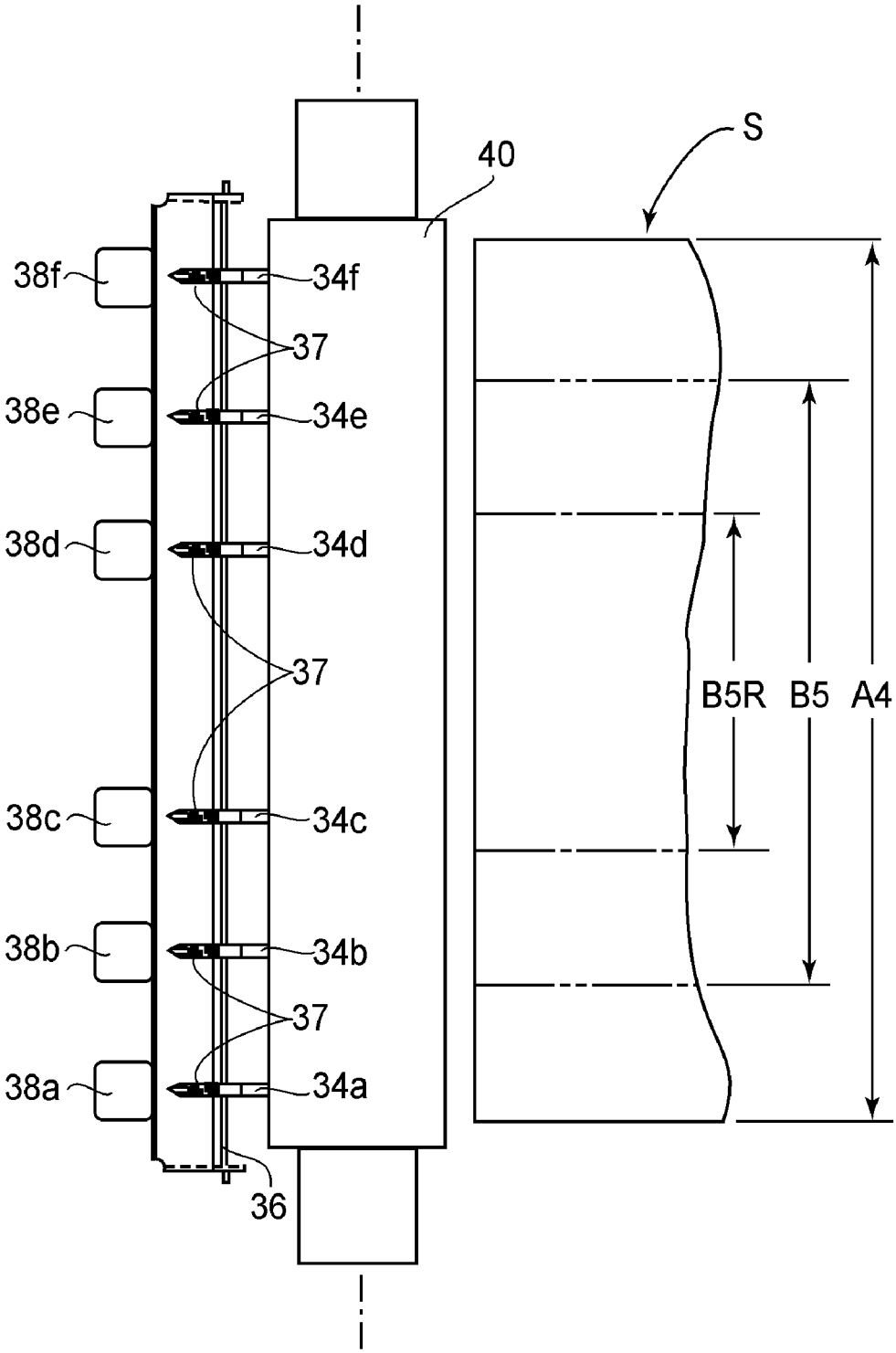
FIG. 8 is a top plan view showing positions of the fixing roller and the separation claw.

The upper separation claw 34 is appropriately arranged correspondingly to various sizes of the recording material S (sheet sizes) with respect to the longitudinal direction of the fixing roller 40. FIG. 8 shows an arrangement example of the upper separation claw 34 in the case where a recording material conveyance center is located at a longitudinal center position, i.e., in the case of center sheet feeding (center line basis conveyance). Upper separation claws 34*a* to 34*f* are provided correspondingly to an A4-sized recording material and the upper separation claws 34*b* to 34*e* are provided correspondingly to a B5-sized recording material. Further, the upper separation claw 34*c* and 34*d* are provided correspondingly to a B5R-sized recording material and contact the fixing roller 40 by the springs 37.

The lower separation claw 35 also has the same constitution as that of the upper separation claw 34 and is provided in a plurality of separation claw portions along a longitudinal direction of the pressing roller 41. That is, the lower separation claw 35 is rotatably supported about the supporting shaft 84 and contacts the pressing roller 41 with a predetermined pressure (=0.049 N (5 gf)) by a spring 81. On a rear end side of the lower separation claw 35, a wire 83 connected to a solenoid 82 as a driving means which is to be turned on and off by the controller A is mounted. When the solenoid 82 is turned on, the lower separation claw 35 is pulled down against the spring 81 on the rear side thereof. As a result, the lower separation claw 35 is rotationally moved about the supporting shaft 84 in a direction in which the lower separation claw 35 is moved apart from the pressing roller 41, so that a front end portion of the lower separation claw 35 is slightly separated from the surface of the pressing roller 41. That is, the lower separation claw 35 is separated from a separation position, in which a separation operation is performed, by turning on the solenoid 82. A distance between the pressing roller 41 and the front end of the lower separation claw 35 is set at 1 mm to 1.5 mm during heating of the pressing roller 41. Then, when the solenoid 82 is turned off, the lower separation claw 35 contacts the pressing roller 41. As the solenoid 82, a latching solenoid is used.

(5) Reason that Roughening Roller 93 and Separation Claw 34 are Required The reason that the roughening roller 93 is required will be described. When a large number of sheets of the recording material S passes through the fixing roller 40 at a certain position, a degree of roughening of the fixing roller surface layer varies depending on areas (portions) including the sheet passing area, the non-sheet passing area, and the sheet edge portion in the boundary between the sheet passing area and the non-sheet passing area.

The surface of the fixing roller 40 including the parting layer of the fluorine-containing resin material or the like as the fixing roller surface layer is in a mirror-surface state and generally has a surface roughness Rz of about 0.1 μm to about 0.3 μm. In the sheet passing area (portion) of the recording material of the fixing roller 40, the fixing roller surface layer is gradually roughened by the attack of fibers, internal and external additives, or the like of the recording material (paper), so that the surface roughness Rz is gradually increased up to about 1.0 μm.

At the sheet edge portion, due to the presence of flash of paper generated during cutting of the paper, the attack on the fixing roller surface layer is large, so that the surface roughness Rz is gradually increased up to about 1.0 μm to about 2.0 μm. The flash of paper is liable to be generated, e.g., when a cutting edge is abraded to be lowered in sharpness in a cutting step of the paper from a large-sized sheet.

In the non-sheet passing area (portion), the recording material S does not pass through the area, so that the surface roughness Rz is increased, up to about 1.0 μm, more slowly than that in the sheet passing area while the fixing roller surface layer contacts the opposite pressing roller 41.

At the separation claw contact portion, the separation claw 34 abrades the fixing roller surface, so that the surface roughness Rz is not increased and is about 0.5 μm.

As a result, the surface roughness of the fixing roller 40 after continuous sheet passing is changed in the order of: (sheet edge portion)>(sheet passing area)>(non-sheet passing area)>(separation claw contact portion)>(initial state). Therefore, the surface state of the fixing roller 40 varies depending on its longitudinal position.

Further, the surface transferability is high during the fixation on the thick paper, so that a minute surface state of the fixing roller 40 is transferred onto the toner image surface after the fixation. When the surface state on the fixing roller is different, a difference in surface state is correspondingly caused on the toner image, thus resulting in an occurrence of the uneven glossiness.

Therefore, the fine traces of abrasion are provided in the entire area (the sheet passing area, the non-sheet passing area, and the sheet edge portion) of the fixing roller surface layer by the roughening roller 93. As a result, the fine traces of abrasion left on the fixing roller surface layer are superposed to eliminate the difference in the uneven surface state in the surface passing area, the non-sheet passing area, and the sheet edge portion on the fixing roller surface layer, so that non-uniform-low glossiness stripe at the sheet edge portion on the image and the difference in glossiness between in the sheet passing area and in the non-sheet passing area can be eliminated.

In order to provide the fine traces of abrasion on the fixing roller surface layer by the roughening roller 93, the rotation of the roughening roller 93 is required to provide a peripheral speed difference with respect to the rotation of the fixing roller 40. For this purpose, in this embodiment, the drive input is made as described above so that the roughening roller 93 and the fixing roller 40 provide the relative speed difference of 1050 mm/sec. However, the roughening effect can also be obtained even when the relative speed difference V is not 1050 mm/sec., i.e., when the relative speed difference is given. That is, the relative speed difference is only required to satisfy the following relationship:

0 mm/sec<(relative speed difference)<2000 mm/sec., preferably, 0 mm/sec<(relative speed difference)<1500 mm/sec.

However, the relative speed difference and a roughening time are in a proportional relationship, so that when the relative speed difference is set at a small value, the roughening time is required to be set at a large value. In this embodiment, the roughening time is set at a time in which the pressing roller is rotated ten times.

Due to the high surface transfer property, the trace of abrasion and the separation claw trace left on the fixing roller surface were visualized on the image in the case where plain paper had the basis weight of 160 g/m$^2$ or more. Further, in a state of the good surface transfer property, even when the fixing roller 40 is roughened by the roughening roller 93 before the fixation, the separation claw trace appears on the image when the separation claw 34 contacts the fixing roller 40 during the sheet passing. That is, the trace of the separation claw 34 is transferred onto the image unless the fixing roller surface is continuously roughened by the roughening roller 93. On the other hand, the sheet edge trace of abrasion occurs at the edge of the paper, so that the sheet edge trace of abrasion does not appear on the image unless the recording material sheet is changed.

In order to prevent the separation claw trace, the fixing roller 40 may be roughened continuously by the roughening roller 93 also during the fixing operation. However, a slight amount of the contamination (foreign matter) such as the offset toner, the paper powder, or the carrier of the developer deposited on the fixing roller surface during the fixing operation can be deposited on the roughening roller surface. When the fixing roller 40 is roughened by the roughening roller 93 on which the foreign matter has been deposited, the surface layer of the fixing roller 40 is damaged, so that an image stripe such as uneven glossiness or the traces of abrasion, can occur on the image.

The reason that the separation claw 34 is required to contact the fixing roller 40 is as follows. That is, the toner is deposited on the fixing roller surface when the unfixed toner on the recording material is crushed in the fixing nip, so that the recording material S winds about the fixing roller 40 without being separated from the fixing roller 40.

In the state in which the recording material S winds about the fixing roller 40 without being separated from the fixing roller 40, the recording material S is still nip-conveyed in the fixing nip, so that a separation force is exerted on the recording material S due to flexibility of the recording material S toward a direction in which the recording material S is separated from the fixing roller 40.

When the separation force by the flexibility of the recording material S is larger than an adhesion force between the fixing roller 40 and the recording material S, the recording material S is separated from the fixing roller 40 and does not wind about the fixing roller. The flexibility of the recording material S is affected by the thickness of the recording material S, thus being smaller with thinner paper and being larger with thicker paper. Therefore, the thin paper is liable to wind about the fixing roller 40 and the thick paper is less liable to wind about the fixing roller 40. When the recording material S does not wind about the fixing roller 40, it is not necessary to separate the recording material S from the fixing roller 40 by the separation claw 34, so that the separation claw 34 can be placed in the separated state from the fixing roller surface.

Under the condition in this embodiment, in the case of using the recording material having the basis weight, of 100 g/m$^2$ or more, as a weight per unit area, the recording material was conveyable even in the state in which the separation claw 34 was separated from the fixing roller 40. Therefore, in this embodiment, in order that the separation claw 34 does not abrade the surface of the fixing roller 40 and that the recording material is separated from the fixing roller 40 with reliability, the separation claw 34 is brought into contact with the fixing roller 40 in the case where the basis weight of the recording material used is 120 g/m$^2$ or less. On the other hand, in the case where the basis weight of the recording material used is more than 120 g/m$^2$, the separation claw 34 is configured to be separated from the fixing roller 40.

In this embodiment, in order to prevent the occurrence of the image stripe due to, for example, uneven glossiness or the traces of abrasion due to the foreign matter deposited on the surface of the roughening roller 93, a cleaning member (not shown) for removing the contamination (the foreign matter) such as the toner or the like on the surface of the roughening roller 93 may also be added.

(6) Operation Display Portion B

Figure 9:
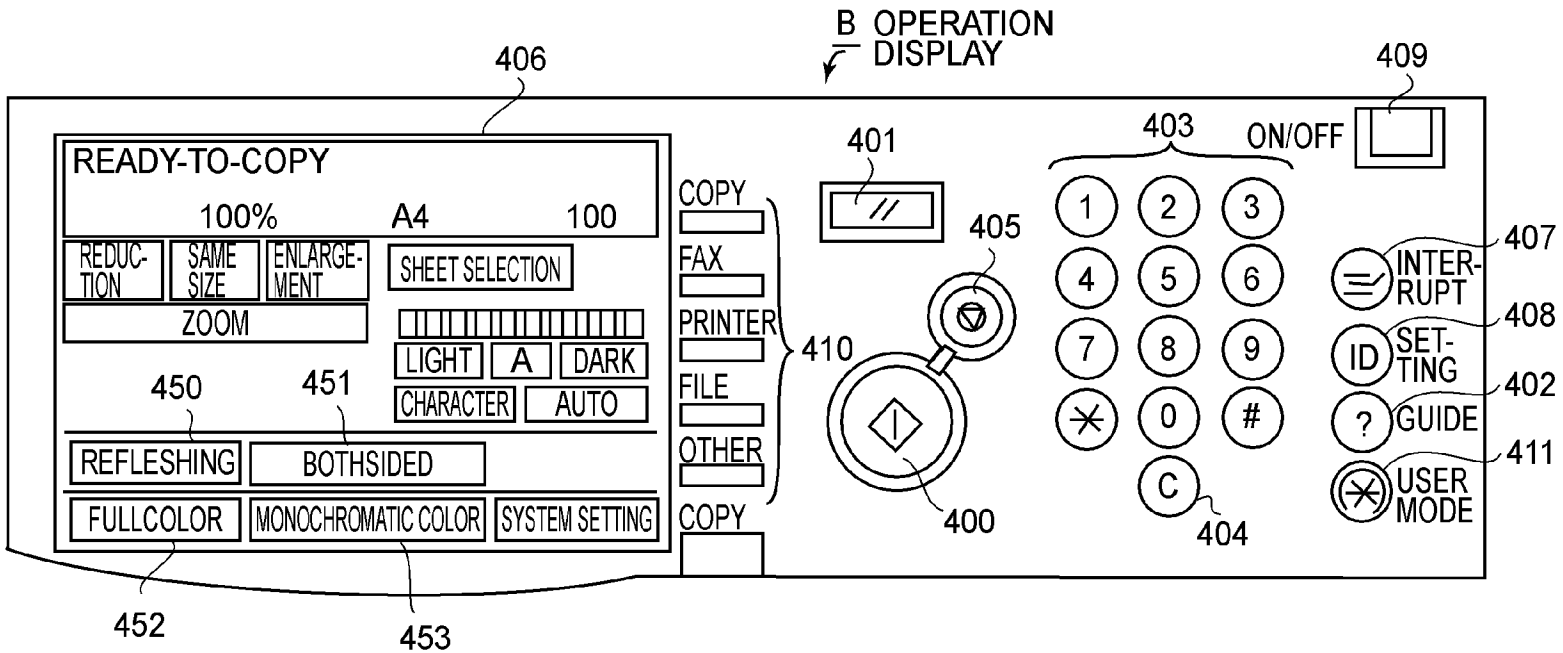
FIG. 9 is a plan view of an operating display portion.

Next, the operation display portion B for permitting operation of the image forming apparatus will be described. FIG. 9 is a plan view of the operation display portion B. The user inputs the basis weight of the recording material to be used through the operation display portion B.

In FIG. 9, a reference numeral 400 represents the copy start key for providing copy start instructions. A reference numeral 401 represents a reset key for returning a current mode to a normal mode. In this embodiment, the normal mode is set for image formation of "monochromatic/one side/non-clear". A reference numeral 402 represents a guidance key to be pressed when a guidance function is used. A reference numeral 403 represents numeric keys for inputting numeric values such as the pre-set number of sheets and the like. A reference numeral 404 represents a clear key for clearing an inputted numeric value. A reference numeral 405 represents a stop key for stopping the copy operation during continuous copying. A reference numeral 406 represents a liquid crystal display portion of a touch panel type for displaying settings for various modes and a state of the printer. A reference numeral 407 represents an interrupt key for making an emergency copy by processing the interrupt during the continuous copying operation or during use as a facsimile machine or a printer. A reference numeral 408 represents a personal identification key for managing the number of sheets copied by individual or division. A reference numeral 409 represents a soft switch for turning on and off an electric power source of an image forming apparatus main assembly. A reference numeral 410 represents function keys to be used when the function of the image forming apparatus is changed. A reference numeral 411 represents a user mode key for entering a user mode in which the user pre-sets items such as ON/OFF of auto cassette change and a change in setting time until the current mode is changed to an energy saving mode. By the setting of the user mode, it is possible to display setting buttons for the user mode on the liquid crystal display portion 406. For example, in FIG. 9, setting of the user mode is made so that a reference numeral 450 represents a refreshing mode selection key, a reference numeral 451 represents a two-side image forming mode selection key, a reference numeral 452 represents a full-color image forming mode selection key, and a reference numeral 453 represents a monochromatic color image forming mode selection key. When the refreshing mode selection key (refreshing button) 450 is pressed, the roughening operation is performed.

(7) Apparatus Operation Control

Figure 10:
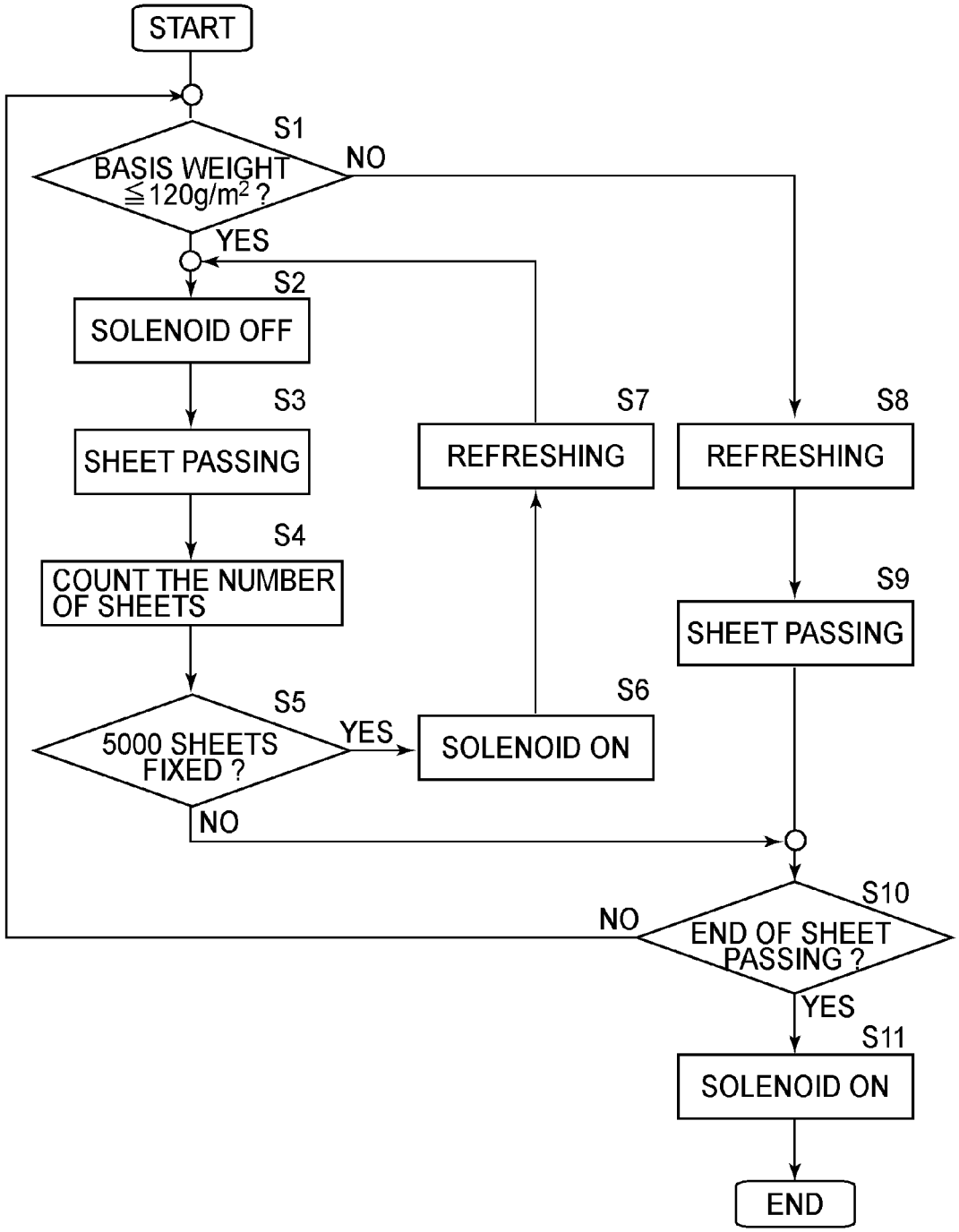
FIG. 10 is a flow chart for explaining an operation in Embodiment 1.

The apparatus operation will be described by using a flow chart shown in FIG. 10. First, in the case of performing a printout operation, the user inputs a transfer paper (recording material) condition and the number of printout copies to be made through the operation display portion B to set a printout condition. Then, the user turns on the copy start key (printout start switch) 400 to start the printout. Then, the controller A as a selecting means selects whether or not the above-described moving means performs a contact operation of the roughening roller 93 with respect to the fixing roller 40 in advance of the heating operation (the fixing operation) by the fixing roller 40 and the pressing roller 41, depending on the basis weight of the recording material (the thickness of the paper) used for the sheet passing. In this embodiment, when the printout is started, the controller A turns off the separation claw separation solenoid 38 in the case where the basis weight of the recording material (the thickness of the paper) used for the sheet passing is not more than a predetermined value (120 g/m$^2$ in this embodiment) on the basis of the user input value. As a result, the separation claw 34 is placed in the contact state with the fixing roller 40 (YES of step S1 and step S2). That is, in the case where the basis weight of the recording material is not more than the above-described predetermined value, the separation claw 34 is located at the separation position in which the separation claw 34 performs the separation operation when the recording material passes through the fixing nip N.

Then, the controller A starts the sheet passing (step S3) to start the image formation and also starts the fixing operation in the fixing device 13.

The controller A has a counting function for counting the number of sheets of the recording material S subjected to the fixation in the state in which the separation claw 34 contacts the fixing roller 40. In the case where the sheet passing of 5000 sheets or more (integrated number of sheets) of the recording material is performed in the contact state of the separation claw 34, the sheet passing job is interrupted and the roughening operation (refreshing operation) of the fixing roller 40 by the roughening roller 93 is started (step S4, YES of step S5, step S6, and step S7). The roughening operation is performed by the contact operation of the roughening roller 93 with respect to the fixing roller 40 performed by the moving means controlled by the controller A. The roughening operation is performed under the above-described condition for the time period corresponding to 10 times of the rotation of the fixing roller 40 with respect to the roughening roller 93 in this embodiment. The controller A performs the separation operation of the roughening roller 93 from the fixing roller 40 after the lapse of the time period. That is, the roughening roller 93 is configured to perform the roughening operation at regular intervals so as not to increase the surface roughness non-uniformity of the fixing roller 40. When the roughening operation is completed, the sheet passing is resumed (step S2 and step S3). When the printout on the set number of sheets is completed in accordance with the above-described routine, the sheet passing is completed (NO of step S5 and YES of step S10). When the sheet passing is completed, the separation claw separation solenoid 38 is turned on, so that the separation claw 34 is moved away from the fixing roller 40 (step S11).

The controller A as the selecting means performs the roughening operation in advance of the heating operation (the fixing operation) by the fixing roller 40 and the pressing roller 41 in the case where the basis weight of the recording material S to be fixed is more than the predetermined value (120 g/m$^2$ in this embodiment). That is, the roughening roller 93 is brought into contact with the fixing roller 40 by the above-described contact and separation mechanism to perform the roughening operation before the sheet passing (NO of step S1 and step S8). By performing the roughening operation in the separated state of the separation claw 34, the surface state of the fixing roller 40 is uniformized. Further, the separation claw 34 is still separated from the fixing roller 40 after the roughening operation, so that the surface state of the fixing roller 40 can be kept at a uniformly roughened state even when the sheet passing is performed (step S9). Then, the apparatus starts the sheet passing to effect the image formation and when the printout on the set number of sheets is completed, the sheet passing is ended and the solenoid is turned on(step S10 and step S11).

With respect to the timing for performing the roughening operation, in order not to increase the sheet edge traces of abrasion and the surface roughness non-uniformity, the roughening operation is performed periodically by using a counter for each of the recording material sizes, in addition to the above-described timing.

Further, when the user is concerned about the uneven glossiness on the image, as the user mode, the constitution in which the fixing roller is uniformly roughened in a stand-by state by providing the operation button 450 to the operation display portion B is also employed.

Further, the roughening time is also adjustable by the user.

As described above, the roughening operation of the fixing roller 40 is performed in advance of the fixing operation when the toner images are fixed on the thin paper having the small basis weight and is not performed in advance of the fixing operation when the toner images are fixed on the thick paper having the large basis weight. As a result, it was possible to prevent the traces (of abrasion) from being transferred from the surface of the fixing roller 40 onto the toner images on the thin paper and to prolong the lifetime of the roughening roller 93.

Embodiment 2

Figure 11:
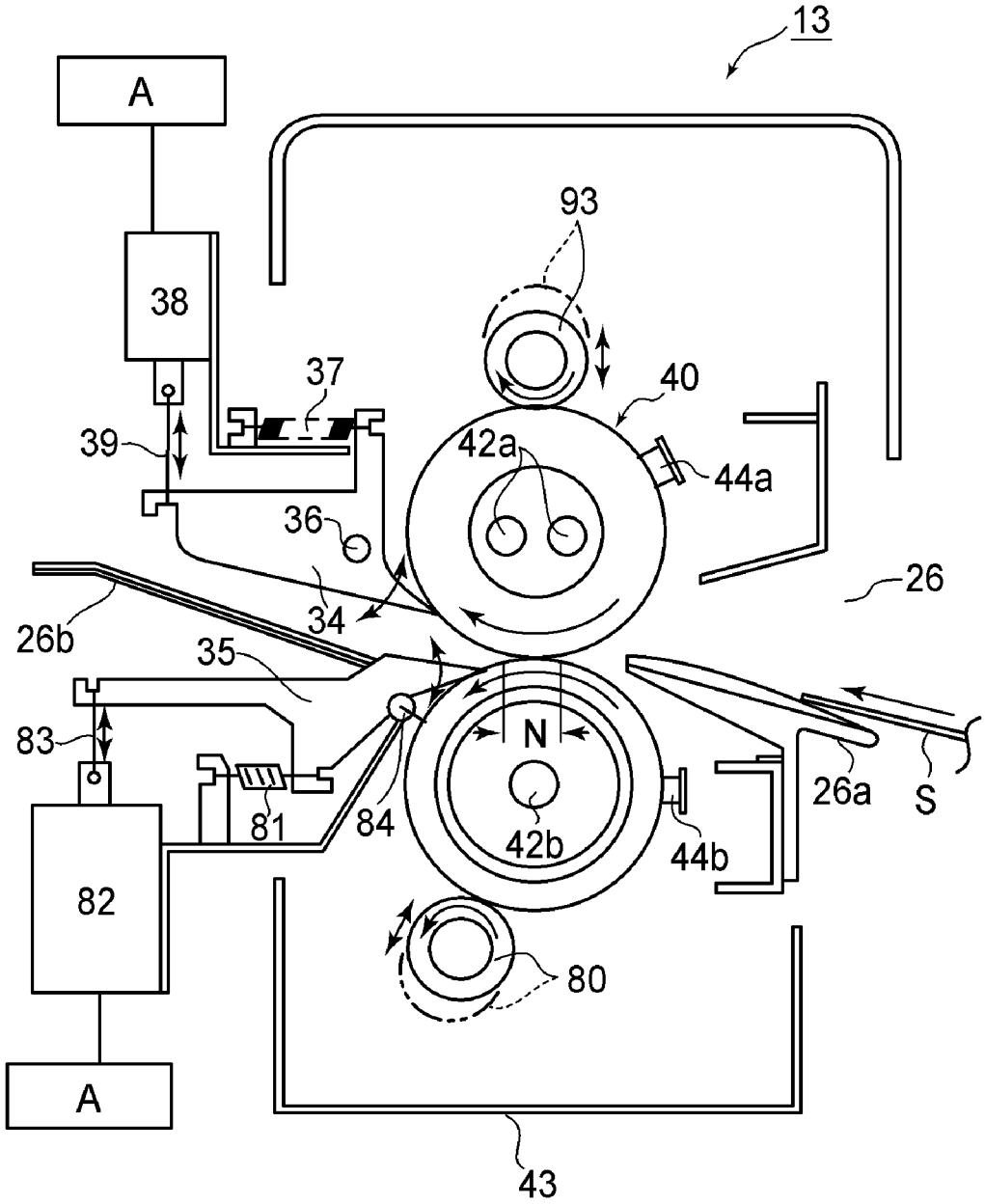
FIG. 11 is an enlarged cross-sectional view of a fixing device of Embodiment 2.

Embodiment 2 will be described with reference to FIG. 11. In recent years, an image forming apparatus capable of printing out the recording material S subjected to two-side-printing has been generally used. For that reason, in the case where two side images are intended to be fixed on the recording material, the separation claw trace (by the separation claw 35) left on the surface of the pressing roller 41 is also transferred onto the toner images on the thick paper when the thick paper is passed through the fixing nip at high speed.

For that reason, similarly as in Embodiment 1, a roughening roller 80 for movement toward and away from the pressing roller 41 may be provided on the pressing roller 41 side. Further, the lower separation claw 35 may also be provided similarly so as to be movable toward and away from the pressing roller 41. As the roughening roller 80, a member having the same constitution as that of the roughening roller 93 for roughening the fixing roller 40 can be used. The roughening roller 80 can be used so as to be pressed against the pressing roller 41 with a total pressure of 10 N to 150 N.

Figure 12:
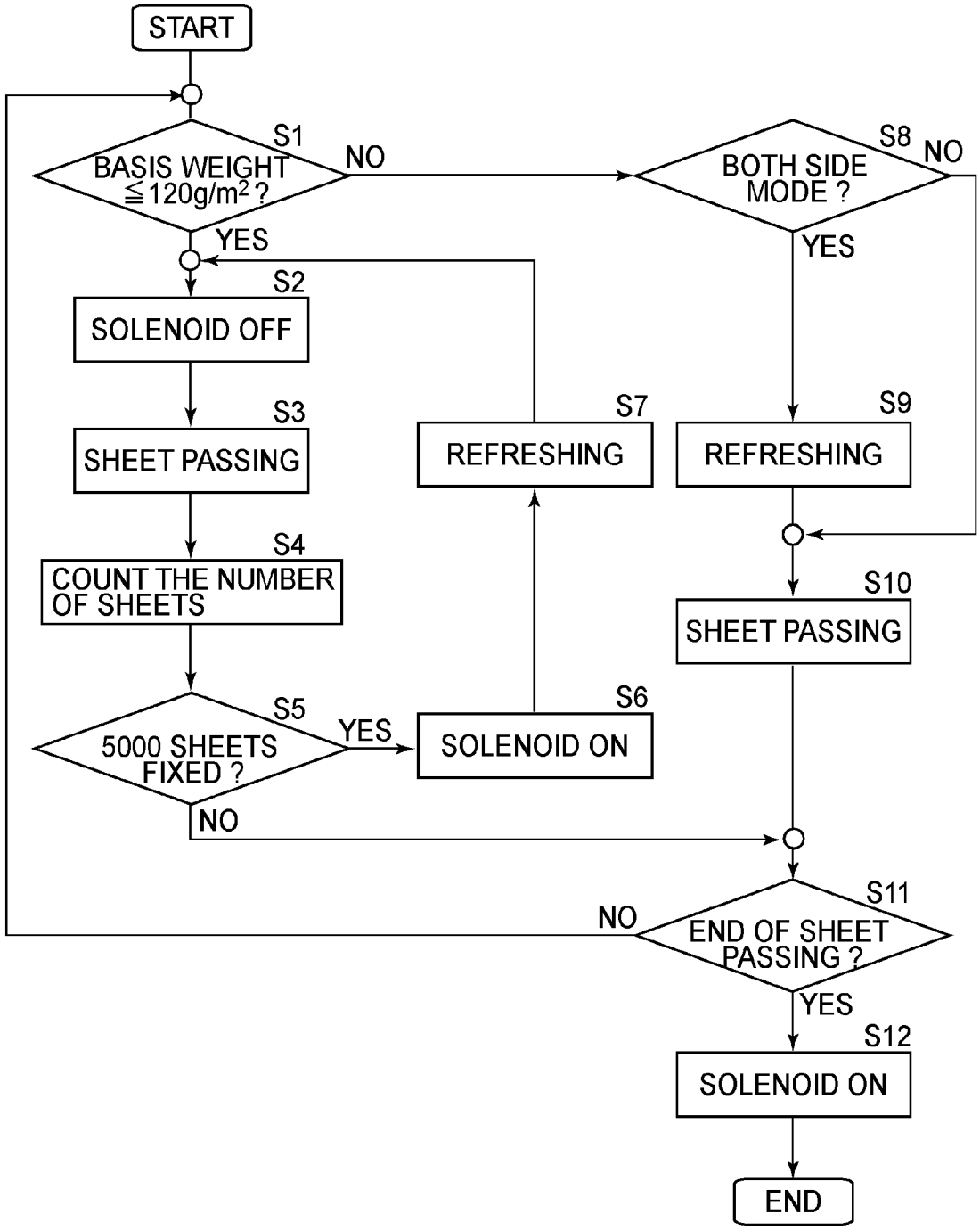
FIG. 12 is a flow chart for explaining an operation in Embodiment 2.
Figure 13:
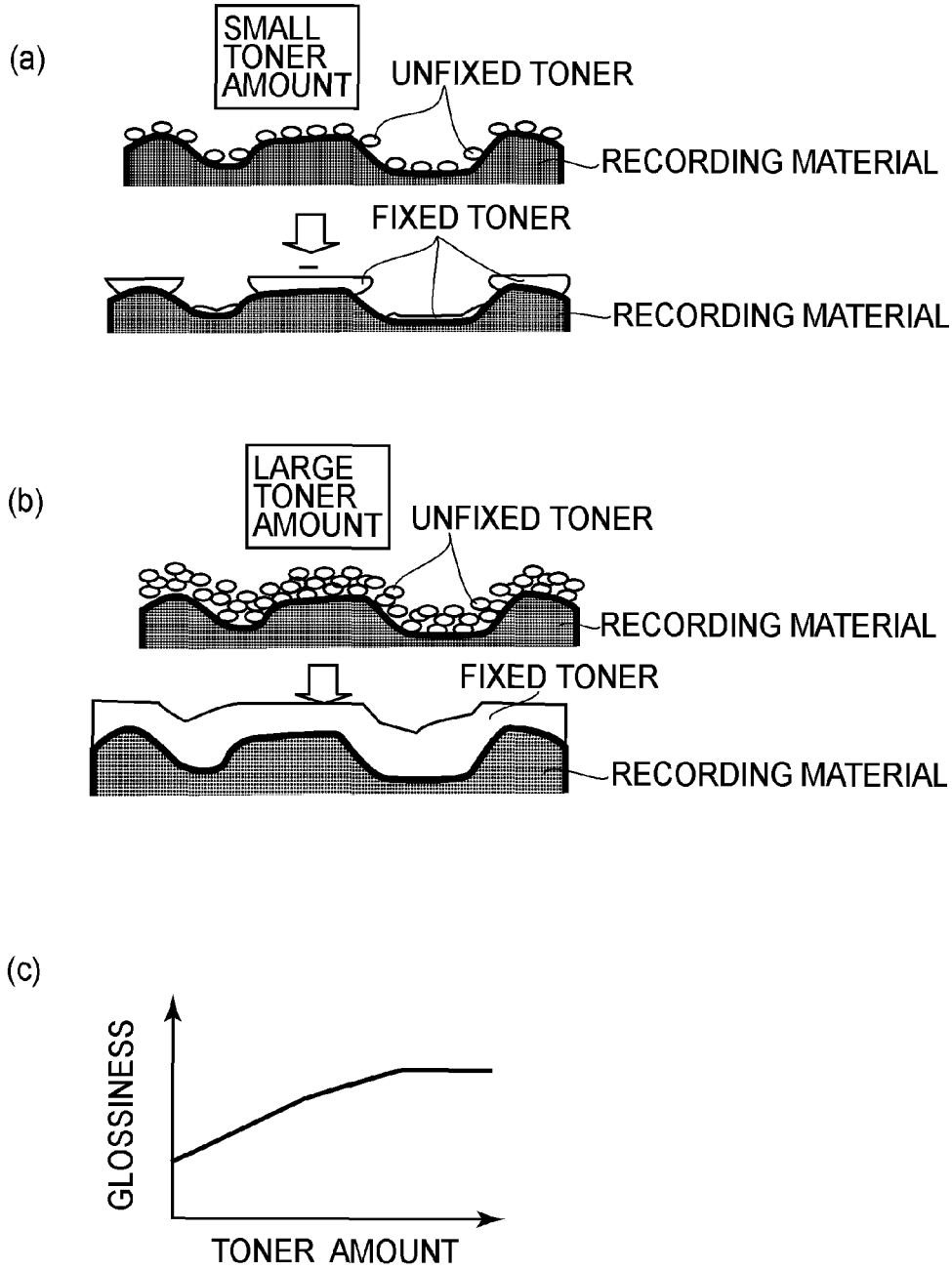
FIGS. 13(*a*) to 13(*c*), FIGS. 14(*a*) to 14(*d*), and FIGS. 15(*a*) to 15(*d*) are schematic views for illustrating a surface transfer property.
Figure 14:
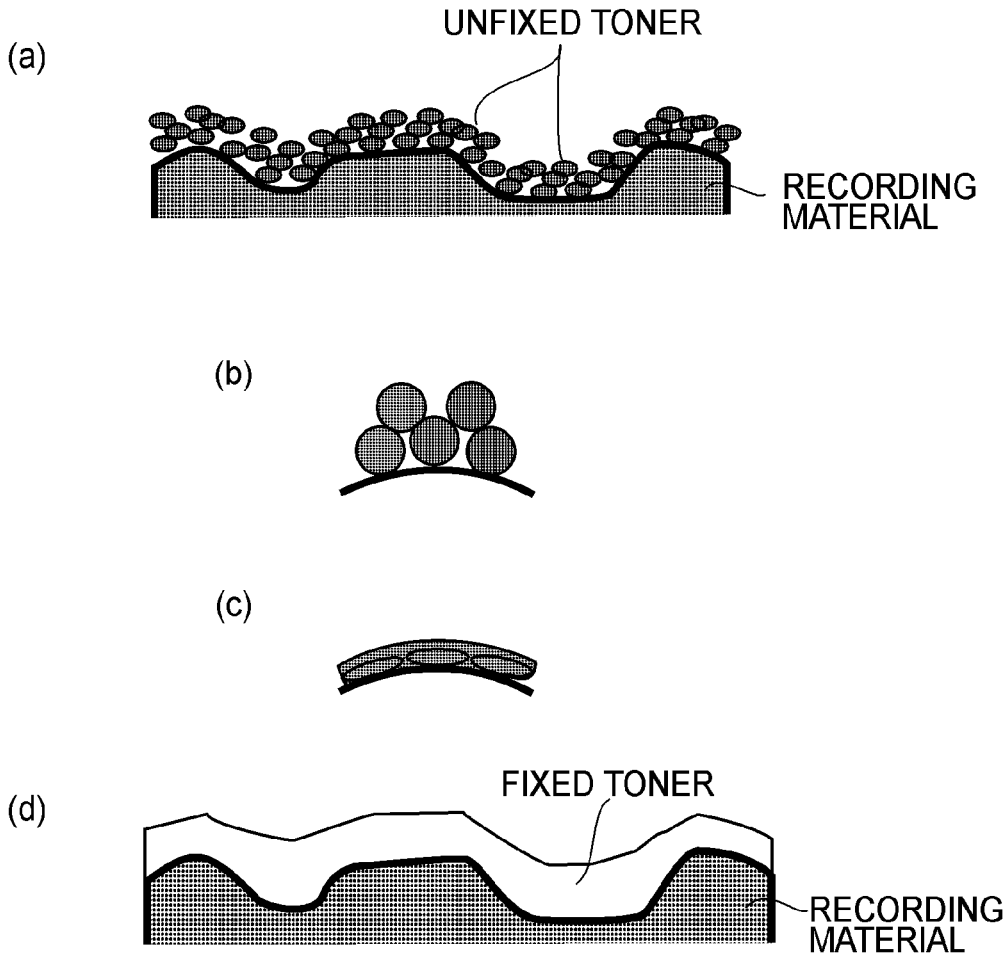
Figure 15:
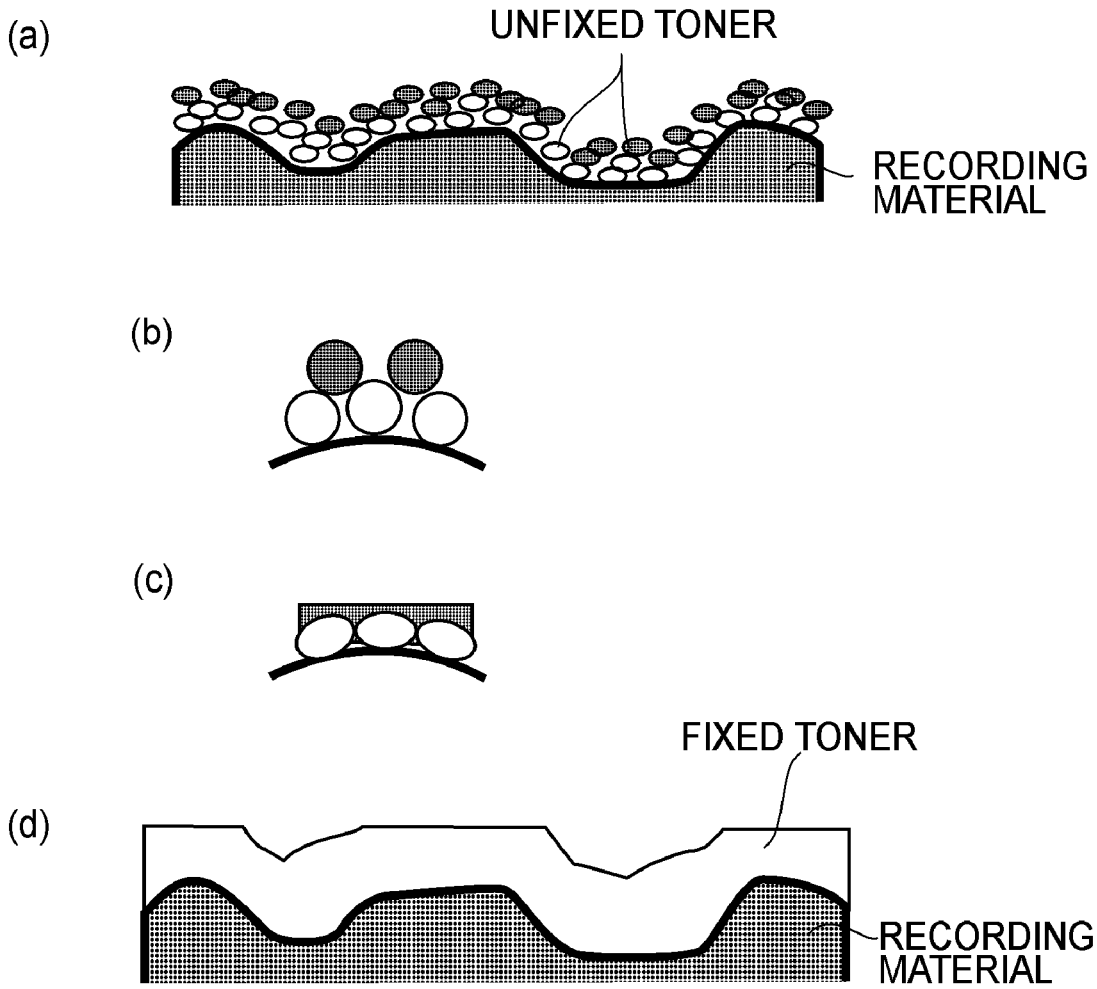

Next, the apparatus operation in Embodiment 2 will be described by using a flow chart shown in FIG. 12. The operation control of the roughening roller 93 and the separation claw 34 with respect to the fixing roller 40 is identical to that in Embodiment 1 (FIG. 10), so that the operation control of the roughening roller 80 and the separation claw 35 with respect to the pressing roller 41 will be described with reference to FIG. 12. First, in the case of performing a printout operation, the user inputs a transfer paper (recording material) condition and the number of printout copies to be made through the operation display portion B to set a printout condition. Then, the user turns on the copy start key (printout start switch) 400 to start the printout. When the printout is started, the controller A turns off a separation claw separation solenoid 82 in the case where the basis weight of the recording material S (the thickness of the paper) used for the sheet passing is not more than 120 g/m$^2$ on the basis of the user input value to bring the separation claw 35 into contact with the pressing roller 41 (YES of step S1 and step S2).

Then, the controller A starts the sheet passing (step S3) to start the image formation and also starts the fixing operation in the fixing device 13.

The controller A has a counting function for (integrally) counting the number of sheets of the recording material S subjected to the fixation in the state in which the separation claw 34 contacts the pressing roller 41. In the case where the sheet passing of 5000 sheets or more (integrated number of sheets) of the recording material is performed in the contact state of the separation claw 35, the sheet passing job is interrupted and the roughening operation (refreshing operation) of the pressing roller 41 by the roughening roller 80 is started by the controller A (step S4, YES of step S5, step S6, and step S7). The roughening operation is performed under the above-described condition for the time period corresponding to 10 times of the rotation of the pressing roller 41 with respect to the roughening roller 80 in this embodiment. The roughening roller 80 is configured to perform the roughening operation at regular intervals so as not to increase the surface roughness non-uniformity of the fixing roller 40. When the roughening operation is completed, the sheet passing is resumed (step S2 and step S3). When the printout on the set number of sheets is completed in accordance with the above-described routine, the sheet passing is completed (NO of step S5 and YES of step S10). When the sheet passing is completed, the separation claw separation solenoid 82 is turned on, so that the separation claw 35 is moved away from the pressing roller 41 (step S11).

In the step S1, in the case where the recording material to be fixed has the basis weight of more than 120 g/m$^2$ and in the case of the two-side-printing mode (YES of step S8), the roughening operation of the pressing roller 41 by the roughening roller 80 is performed before the sheet passing (step S9). This roughening operation is performed for a time period corresponding to 10 times of the rotation of the pressing roller 41 with respect to the roughening roller 80 in the state in which the separation claw 35 is moved apart from the pressing roller 41.

Then, the controller A starts the sheet passing operation (step S10) to execute the image formation operation and then completes the sheet passing operation when the printout on the set number of sheets is ended. In the case where the paper (recording material) to be fixed has the basis weight of not less than 120 g/m$^2$ and in the case of one-side-printing mode, the separation claw 35 is in the separated state, so that the sheet passing is started as it is to effect the image formation. When the printout on the set number of sheets is completed, the sheet passing is ended (step S11) and the solenoid is turned on (step S12).

By employing the above-described constitution, similarly as in Embodiment 1, it is possible to obtain a good image even during the both-side-printout.

As described above, the roughening operation of the fixing roller 40 is performed in advance of the fixing operation when the toner images are fixed on the thin paper having the small basis weight and is not performed in advance of the fixing operation when the toner images are fixed on the thick paper having the large basis weight. As a result, it was possible to prevent the traces (of abrasion) from being transferred from the surface of the pressing roller 40 onto the toner images on the thin paper and to prolong the lifetime of the roughening roller 80.

Embodiment 3

As described above, when the recording material conveying speed is increased, the surface transfer property is enhanced. In the state in which the surface transfer property is enhanced, the glossiness of the toner images after the fixation is enhanced.

Further, in the case where the toner images are formed on both sides of the recording material, the glossiness of the toner images formed on the recording material surface after second passing of the recording material through the fixing nip is higher than that after first passing of the recording material through the fixing nip. This is because the toner images formed on the recording material surface are heated again by the pressing roller 41 during the second passing of the recording material through the fixing nip. When the glossiness of the toner images is increased, the separation claw trace (by the separation claw 35) left on the surface of the pressing roller 41 is more visible. Further, a difference in glossiness between the front-side toner images and the rear-side toner images is also increased.

In the case where the toner images are formed on the both side surfaces of the recording material, the recording material passes through the fixing device 13 two times, so that there is of no problem practically if the amount of heat to be applied to the toner images is decreased during the first passing of the recording material through the fixing nip so that the toner images are fixed with reliability at the time of completion of the second passing of the recording material.

Therefore, when the temperature on the pressing roller 41 side is lowered and set at 150° C. during the two-side-printing (while the fixing roller 40 is kept at 180° C.), the separation claw trace left on the surface of the pressing roller 41 is less visible, so that the toner image glossiness difference between the front surface and the rear surface is also reduced. Further, a fixing property is also ensured, so that a better image can be obtained.

As described above, due to the melting of only the transfer surface by high-speed printing, even when the transfer layer does not follow the uneven surface of the recording material but follows the surface of the fixing roller, the fixing roller surface is uniformly roughened by the abrading member (roughening member) during the passing of the recording material having the large basis weight (during the passing of the thick paper). For that reason, the uneven glossiness on the image such as the sheet edge trace of abrasion or the separation claw trace is eliminated, so that it is possible to obtain a good image.

The separation claw is moved away from the fixing roller surface during the passing of thick paper and therefore the separation claw trace is not left on the fixing roller surface also during the sheet passing, so that there is no separation claw trace (no uneven glossiness) on the image and therefore a good image can be obtained.

During the thin paper passing, the separation claw contacts the fixing roller, so that a separation performance can be kept at the same level as that of a conventional device.

In the case of the plain paper, by bringing the separation claw into contact with the fixing roller with a basis weight of not more than 120 g/m$^2$ and by moving the separation claw away from the fixing roller with the basis weight of more than 120 g/m$^2$, it is possible to retain the state of a good separation performance with no image defect even when the paper with any basis weight is subjected to the fixation.

Even in the case where the separation claw is often brought into contact with the fixing roller surface in such a state that the thin paper is predominantly used as the recording material compared with the thick paper, the fixing roller surface is made uniform by roughening periodically by the roughening member. Thus, when the fixing roller surface is roughened by the roughening member, roughening non-uniformity does not occur and durability is of no problem.

Even in the case of the two-side-sheet passing, the pressing roller surface is uniformly roughened by the roughening member during the passing of the thick paper, so that the uneven glossiness on the image, due to, for example, sheet edge trace of abrasion or the separation claw trace can be eliminated to obtain a good image.

During the passing of the thick paper, the separation claw is moved away from the pressing roller surface, so that the separation claw does not contact the pressing roller surface even during sheet passing. For that reason, even in the case of the two-side-sheet passing, the separation claw trace (the uneven glossiness) on the image is eliminated, so that it is possible to obtain a good image.

During thin paper passing, the separation claw contacts the pressing roller, so that the separation performance can be kept at a level equivalent to that of the conventional device even in the case of the two-side-sheet passing.

In the case of the plain paper, by bringing the separation claw into contact with the pressing roller when the plain paper has a basis weight of not more than 120 g/m$^2$ and by moving the separation claw away from the pressing roller when the paper has a basis weight of more than 120 g/m$^2$, it is possible to retain the state of a good separation performance with no image defect even when paper with any basis weight is subjected to the fixation.

Even in the case where the separation claw is often brought into contact with the pressing roller surface in such a state that the thin paper is predominantly used as the recording material compared with the thick paper, the pressing roller surface is kept uniform by roughening periodically by the roughening member. Thus, when the pressing roller surface is roughened by the roughening member, the roughening non-uniformity does not occur and durability is not a problem.

In the case where the toner images are formed on two surfaces of the recording material, the temperature of the pressing roller 41 is lowered during the second passing of the recording material through the fixing nip, so that it is possible to prevent toner image glossiness on the front surface from excessively increasing compared with the toner image glossiness on the rear surface. Therefore, the glossiness difference between the toner images on the front surface and the rear surface is reduced, so that a good image can be obtained.

The roughening roller as the abrading member abrades at least one of the fixing roller 40 and the pressing roller 41 as a pair of rotatable members. Further, the separating member separates the recording material having passed through the heating nip from the rotatable member which is capable of being abraded by the abrading member.

The present invention is described above based on the specific embodiments but is not limited thereto. For example, the image heating apparatus is not limited to the fixing device for fixing the unfixed toner images, formed on the recording material, on the recording material. It is also possible to use the image heating apparatus as a smoothness-enhancing apparatus and a glossiness-enhancing apparatus which are used for increasing the smoothness and glossiness of the image by heating the toner images again after the toner images are fixed on the recording material, so that the same effect as that described above can be achieved.

Further, as the pair of rotatable members, such an embodiment that the fixing process is performed by the roller-like members such as the fixing roller and the pressing roller is described but the present invention is also applicable to even an apparatus (device) for performing the fixing process by using belt-like members (a fixing belt and a pressing belt) as the pair of rotatable members.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 137768/2008 filed May 27, 2008, which is hereby incorporated by reference.

What is claimed is:

1. An image heating apparatus comprising:

a heating member configured to heat a toner image on a recording material in a heating nip;

a pressing member configured to form the heating nip and being in contact with said heating member;

an abrading member configured to abrade a surface of said heating member;

contact-and-separation means for causing contact and separation of said abrading member with respect to said heating member; and selecting means for selecting, depending on the basis weight of the recording material to be heated by said heating member, whether or not said contact-and-separation means brings said abrading member into contact with said heating member before the recording material is conveyed to the heating nip.

2. An apparatus according to claim 1, wherein said selecting means causes said contact-and-separation means to bring said abrading member into contact with said heating member when the basis weight of the recording material is more than a predetermined amount.

3. An apparatus according to claim 2, wherein said abrading member has a surface roughness R2 of 3 μm to 16 μm at a surface on which said abrading member contacts said heating member.

4. An apparatus according to claim 3, further comprising a separating member configured to separate the recording material, which has passed through the heating nip, from said heating member, wherein said contact-and-separation means moves apart from a separation position, for permitting separation of the recording material from said heating member, before said contact-and-separation means brings said abrading member into contact with said heating member.

5. An apparatus according to claim 4, wherein said separation member is located at the separation position during passing of the recording material through the heating nip when the basis weight of the recording material is less than the predetermined amount.

* * * * *